US007875410B2

(12) United States Patent
Ogaki et al.

(10) Patent No.: US 7,875,410 B2
(45) Date of Patent: Jan. 25, 2011

(54) ELECTROPHOTOGRAPHIC PHOTOSENSITIVE MEMBER HAVING SILOXANE-POLYESTER, PROCESS CARTRIDGE AND ELECTROPHOTOGRAPHIC APPARATUS

(75) Inventors: Harunobu Ogaki, Suntou-gun (JP); Hiroki Uematsu, Suntou-gun (JP); Atsushi Ochi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/637,158

(22) Filed: Dec. 14, 2009

(65) Prior Publication Data

US 2010/0092208 A1 Apr. 15, 2010

Related U.S. Application Data

(63) Continuation of application No. PCT/JP2009/063230, filed on Jul. 16, 2009.

(30) Foreign Application Priority Data

Jul. 18, 2008 (JP) ..... 2008-187180

(51) Int. Cl.
*G03G 5/05* (2006.01)

(52) U.S. Cl. ..... 430/58.8; 430/59.6

(58) Field of Classification Search ..... 430/59.6, 430/58.8; 399/159
See application file for complete search history.

(56) References Cited

U.S. PATENT DOCUMENTS

| | | | | |
|---|---|---|---|---|
| 5,208,127 | A | 5/1993 | Terrell et al. | 430/59 |
| 5,208,128 | A | 5/1993 | Terrell et al. | 430/59 |
| 5,834,146 | A * | 11/1998 | Hoshizaki et al. | 430/58.5 |
| 5,876,888 | A * | 3/1999 | Anayama et al. | 430/58.2 |
| 6,093,515 | A | 7/2000 | Yoshida et al. | 430/96 |
| 6,110,628 | A | 8/2000 | Sekiya et al. | 430/66 |
| 6,146,800 | A | 11/2000 | Yoshida et al. | 430/67 |
| 7,585,604 | B2 | 9/2009 | Ogaki et al. | 430/59.1 |
| 7,645,547 | B2 | 1/2010 | Okuda et al. | 430/56 |
| 2002/0018948 | A1 * | 2/2002 | Takeshima et al. | 430/58.2 |
| 2006/0035161 | A1 * | 2/2006 | Kawamura et al. | 430/59.6 |
| 2006/0269857 | A1 | 11/2006 | Hayata et al. | 430/60 |
| 2009/0324282 | A1 | 12/2009 | Ogaki et al. | 399/111 |

FOREIGN PATENT DOCUMENTS

| | | | |
|---|---|---|---|
| JP | 03-185451 | | 8/1991 |
| JP | 08-234468 | | 9/1996 |
| JP | 11-143106 | | 5/1999 |
| JP | 11-194522 | | 7/1999 |
| JP | 2000-075533 | | 3/2000 |
| JP | 2002-128883 | | 5/2002 |
| JP | 2002-214807 | | 7/2002 |
| JP | 2002214807 | A * | 7/2002 |
| JP | 2002251022 | A * | 9/2002 |
| JP | 2003262968 | A * | 9/2003 |
| JP | 2003-302780 | | 10/2003 |
| JP | 2005-242373 | | 9/2005 |
| JP | 2007-004133 | | 1/2007 |
| JP | 2007-199686 | | 8/2007 |
| JP | 2007-199688 | | 8/2007 |

OTHER PUBLICATIONS

English language machine translation of JP 2002-214807 (Jul. 2002).*
English language machine translation of JP 2002-251022 (Sep. 2002).*
English language machine translation of JP 2003-262968 (Sep. 2003).*
International Search Report issued in the corresponding International Application PCT/JP2009/063230 dated Oct. 6, 2009 (11 pages).

* cited by examiner

*Primary Examiner*—Christopher RoDee
(74) *Attorney, Agent, or Firm*—Fitzpatrick, Cella, Harper & Scinto

(57) ABSTRACT

A charge transport layer serving as a surface layer of an electrophotographic photosensitive member contains a charge transporting material, polyester resin A containing a siloxane moiety and at least one of polyester resin C and polycarbonate resin D. The content of a siloxane moiety in polyester resin A is not less than 10% by mass and not more than 40% by mass relative to the total mass of polyester resin A. The charge transport layer has a matrix-domain structure having a matrix formed of the charge transporting material and at least one of polyester resin C and polycarbonate resin D and a domain formed of polyester resin A in the matrix.

9 Claims, 2 Drawing Sheets

ELECTROPHOTOGRAPHIC PHOTOSENSITIVE MEMBER HAVING SILOXANE-POLYESTER, PROCESS CARTRIDGE AND ELECTROPHOTOGRAPHIC APPARATUS

CROSS-REFERENCE TO RELATED APPLICATIONS

This application is a continuation of International Application No. PCT/JP2009/063230, filed Jul. 16, 2009, which claims the benefit of Japanese Patent Application No. 2008-187180, filed Jul. 18, 2008.

BACKGROUND OF THE INVENTION

1. Field of the Invention

The present invention relates to an electrophotographic photosensitive member, a process cartridge having an electrophotographic photosensitive member and an electrophotographic apparatus.

2. Description of the Related Art

As a photoconductive substance (a charge generating material and a charge transporting material) used in an electrophotographic photosensitive member, which is installed in an electrophotographic apparatus, development of organic photoconductive substances have been aggressively performed.

The electrophotographic photosensitive member (organic electrophotographic photosensitive member) using an organic photoconductive substance usually has a photosensitive layer, which is formed by applying a coating solution obtained by dissolving/dispersing an organic photoconductive substance and a resin (a binder resin) in a solvent, onto a support, and drying it. Furthermore, as the layer structure of a photosensitive layer, a laminate type (successive layer type) is generally employed, which is formed by stacking a charge generation layer and a charge transport layer successively in this order on a support.

An electrophotographic photosensitive member using an organic photoconductive substance does not always satisfy all characteristics required for an electrophotographic photosensitive member at high levels. In the electrophotographic process, various types of members such as a developer, a charging member, a cleaning blade, a paper sheet and a transfer member (hereinafter referred also to as "contact members") come into contact with the surface of the electrophotographic photosensitive member. As a characteristic required for an electrophotographic photosensitive member, reducing image deterioration caused by contact stress with these contact members may be mentioned. Particularly, as the durability of an electrophotographic photosensitive member improves in recent years, it has been desired to maintain the effect of reducing image deterioration caused by the contact stress.

As to mitigating the contact stress, it has been proposed to add a siloxane modified resin, which has a siloxane structure in a molecular chain, to the surface layer of an electrophotographic photosensitive member to be in contact with the various members. For example, Japanese Patent Application Laid-Open No. H11-143106 (Patent Document 1) and Japanese Patent Application Laid-Open No. 2007-199688 (Patent Document 2) disclose a resin having a siloxane structure integrated into a polycarbonate resin. Japanese Patent Application Laid-Open No. H03-185451 (Patent Document 3) discloses a resin having a siloxane structure integrated into a polyester resin. Furthermore, Japanese Patent Application Laid-Open No. H11-194522 (Patent Document 4) discloses a resin having a cyclic siloxane structure integrated into a polyester resin and Japanese Patent Application Laid-Open No. 2000-075533 (Patent Document 5) discloses a resin having a branched siloxane structure integrated therein. Furthermore, Japanese Patent Application Laid-Open No. 2002-128883 (Patent Document 6) discloses a resin having a siloxane structure integrated at an end of a polyester resin. Furthermore, Japanese Patent Application Laid-Open No. 2003-302780 (Patent Document 7) discloses a technique for adding a polyester resin having a siloxane structure and a compound having a polymerizable functional group to the surface layer of an electrophotographic photosensitive member.

Furthermore, Japanese Patent Application Laid-Open No. 2007-004133 (Patent Gazette 8) discloses a technique for forming a domain in the surface layer of an electrophotographic photosensitive member using a block-copolymer resin material having a siloxane structure.

Similarly, Japanese Patent Application Laid-Open No. 2005-242373 (Patent Document 9) discloses a technique for using a silicone material by dispersing it like particles in a charge transport layer of an electrophotographic photosensitive member and shows that discharge breakdown is effectively inhibited and image deterioration (black mark) can be suppressed.

However, the polycarbonate resins disclosed in Patent Documents 1 and 2, are inferior in mechanical strength compared to the polyester resin, in particular, an aromatic polyester resin. Therefore, they may not be sufficient in order to satisfy durability improvement recently required in balance. Furthermore, in the resins disclosed in Patent Documents 1 and 2, there is a polycarbonate resin having a siloxane structure integrated therein migrating to the surface of a surface layer when a plurality of types of resins are used in combination in the surface layer. This is an effective approach in mitigating the contact stress in the beginning of use of an electrophotographic photosensitive member; however, this approach may not be sufficient in view of persistency of the effect.

Furthermore, a compound having a benzidine skeleton serving as a charge transporting material contained in the charge transport layer, is one of the materials having high electrophotographic characteristics. However, some of the resins disclosed in Patent Documents 1 and 2 cause phase separation with a compound having a benzidine skeleton and decrease potential stability during repeated use.

Furthermore, the polyester resin disclosed in Patent Document 3 is a resin formed by block copolymerization of a siloxane structure and an aromatic polyester structure. In this resin, phase separation occurs with a charge transporting material to form aggregates of the charge transporting material therein. Thus, the resin is inferior in potential stability during repeated use.

Furthermore, the resin disclosed in Patent Document 4 is excellent in mechanical strength; however, the effect of mitigating the contact stress may not be sufficient.

Furthermore, the resin disclosed in Patent Document 5 is excellent in mitigating the contact stress; however, a phase separation with a charge transporting material occurs and potential stability decreases during repeated use in some cases.

Furthermore, in the resin disclosed in Patent Document 6, the effect of mitigating the contact stress is not sufficient. Furthermore, when a plurality of resins is used in combination in the surface layer, the resin disclosed in Patent Document 6 tends to migrate to the surface of the surface layer. Therefore, it is not sufficient in view of persistency of the effect.

Furthermore, the resin disclosed in Patent Document 7 is not sufficient in view of mitigation of the contact stress and, in addition, phase separation occurs with a charge transporting material and potential stability decreases during repeated use in some cases.

Furthermore, the material disclosed in Patent Document 8 is a resin having a component having a low surface energy and a matrix component in the same resin. The component having a low surface energy forms a domain and producing a low surface energy state. However, when the surface layer is a charge transport layer of a laminate type photosensitive layer, since a siloxane moiety expressing a low surface energy property has a high migration property to the interface and tend to be present in the interface between a charge transport layer and a charge generation layer, the electrophotographic photosensitive member sometimes causes a significant potential change. Also in the electrophotographic photosensitive member manufactured by using the materials described in Patent Document 8, a significant potential change sometimes occurs for the same reason described above. Furthermore, in the electrophotographic photosensitive member disclosed in Patent Document 9 in which a silicone material are dispersed like particles in a charge transport layer, a significant potential change sometimes occurs for the same reason described above.

SUMMARY OF THE INVENTION

It is an object of the present invention is to provide an electrophotographic photosensitive member capable of persistently exerting an effect of mitigating contact stress with contact members and excellent also in potential stability during repeated use, and to provide a process cartridge and electrophotographic apparatus having the electrophotographic photosensitive member.

The present invention provides an electrophotographic photosensitive member having a support, a charge generation layer provided on the support, and a charge transport layer containing a charge transporting material and a resin (a binder resin) and formed on the charge generation layer, the charge transport layer serving as a surface layer of the electrophotographic photosensitive member, wherein: the charge transport layer contains a charge transporting material, a polyester resin A having a repeating structural unit represented by the following formula (1) and a repeating structural unit represented by the following formula (2), and at least one of polyester resin C having a repeating structural unit represented by the following formula (C) and polycarbonate resin D having a structural unit represented by the following formula (D); the content of a siloxane moiety in the polyester resin A is not less than 10% by mass and not more than 40% by mass relative to the total mass of the polyester resin A; and the charge transport layer has a matrix-domain structure having a matrix formed of the charge transporting material and at least one of polyester resin C and polycarbonate resin D, and a domain formed of polyester resin A in the matrix (1)

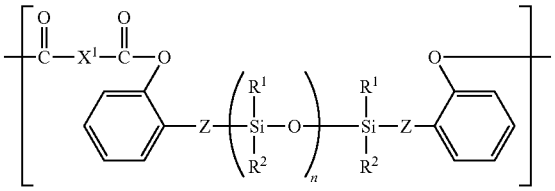

where, in formula (1), $X^1$ represents a divalent organic group; $R^1$ and $R^2$ each independently represent a substituted or unsubstituted alkyl group or a substituted or unsubstituted aryl group; Z represents a substituted or unsubstituted alkylene group having 1 or more and 4 or less carbon atoms; and n represents an average number of repetitions of a structure within the brackets, ranging from 20 or more and 150 or less, (2)

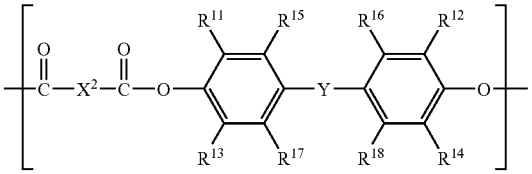

where, in formula (2), $R^{11}$ to $R^{18}$ each independently represent a hydrogen atom, a substituted or unsubstituted alkyl group, a substituted or unsubstituted aryl group or a substituted or unsubstituted alkoxy group; $X^2$ represents a divalent organic group; and Y represents a single bond, a substituted or unsubstituted alkylene group, a substituted or unsubstituted arylene group, an oxygen atom or a sulfur atom, (C)

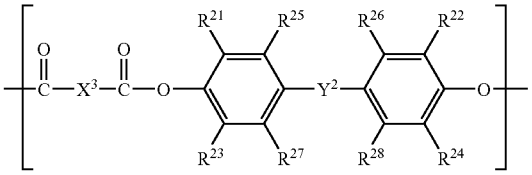

where, in formula (C), $R^{21}$ to $R^{28}$ each independently represent a hydrogen atom, a substituted or unsubstituted alkyl group, a substituted or unsubstituted aryl group or a substituted or unsubstituted alkoxy group; $X^3$ represents a divalent organic group; and $Y^2$ represents a single bond, a substituted or unsubstituted alkylene group, a substituted or unsubstituted arylene group, an oxygen atom or a sulfur atom, (D)

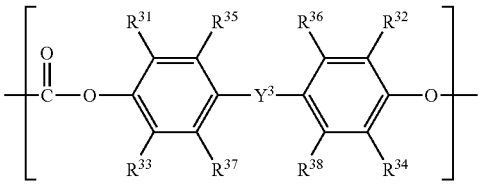

where, in formula (D), $R^{31}$ to $R^{38}$ each independently represent a hydrogen atom, a substituted or unsubstituted alkyl group, a substituted or unsubstituted aryl group or a substituted or unsubstituted alkoxy group; and $Y^3$ represents a single bond, a substituted or unsubstituted alkylene group, a substituted or unsubstituted arylene group, an oxygen atom or a sulfur atom.

Furthermore, the present invention provides a process cartridge having the above mentioned electrophotographic photosensitive member and at least one device selected from the group consisting of a charging device, a developing device, a transfer device and a cleaning device, wherein the electrophotographic photosensitive member and the at least one device are integrally supported and detachably mountable to a main body of an electrophotographic apparatus.

Furthermore, the present invention provides an electrophotographic apparatus having the above electrophotographic photosensitive member, a charging device, an exposure device, a developing device and a transfer device.

According to the present invention, it is possible to provide an electrophotographic photosensitive member capable of persistently exerting an effect of mitigating contact stress with contact members and excellent in potential stability during repeated use, and to provide a process cartridge and electrophotographic apparatus having the electrophotographic photosensitive member.

Further features of the present invention will become apparent from the following description of exemplary embodiments with reference to the attached drawings.

DESCRIPTION OF THE EMBODIMENTS

Figure 1:
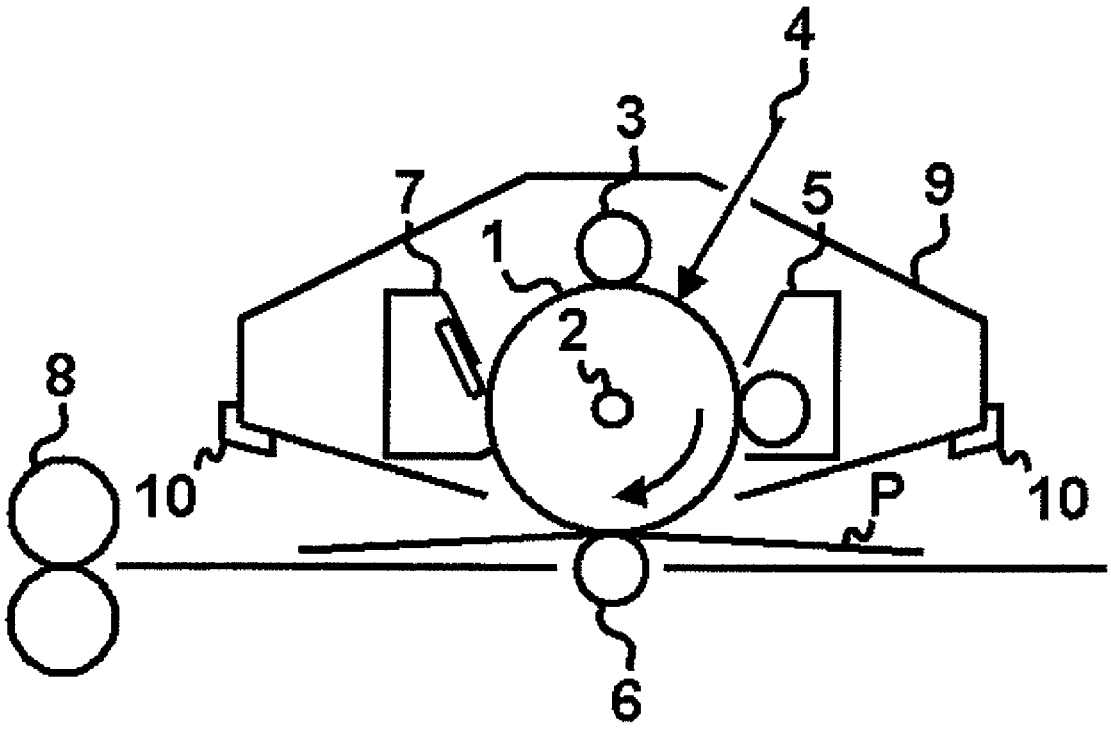
FIG. 1 is a view schematically illustrating a structure of an electrophotographic apparatus provided with a process cartridge having the electrophotographic photosensitive member of the present invention.

Preferred embodiments of the present invention will now be described in detail in accordance with the accompanying drawings.

The electrophotographic photosensitive member of the present invention is an electrophotographic photosensitive member having a support, a charge generation layer provided on the support and a charge transport layer containing a charge transporting material and a resin (a binder resin) and formed on the charge generation layer, and also serving as a surface layer, as described above. Furthermore, the charge transport layer contains a charge transporting material, polyester resin A (hereinafter also simply referred to as "polyester resin A") having a repeating structural unit represented by the following formula (1) and a repeating structural unit represented by the following formula (2) and at least one of polyester resin C (hereinafter also simply referred to as "polyester resin C") having a repeating structural unit represented by the following formula (C) and polycarbonate resin D (hereinafter simply referred to as "polycarbonate resin D") having a structural unit represented by the following formula (D). Furthermore, the content of a siloxane moiety in the polyester resin A is not less than 10% by mass and not more than 40% by mass relative to the total mass of the polyester resin A. Furthermore, the charge transport layer has a matrix-domain structure having a matrix formed of the charge transporting material and at least one of the polyester resin C and the polycarbonate resin D, and a domain formed of the polyester resin A in the matrix.

(1)

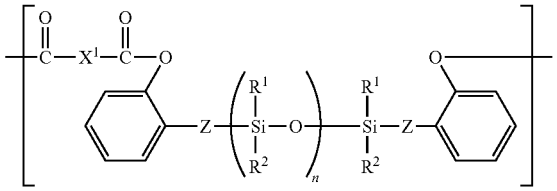

In the above formula (1), $X^1$ represents a divalent organic group; $R^1$ and $R^2$ each independently represent a substituted or unsubstituted alkyl group or a substituted or unsubstituted aryl group; Z represents a substituted or unsubstituted alkylene group having 1 or more and 4 or less carbon atoms; and n represents an average value of the number of repeats of a structure within the brackets, ranging from 20 or more and 150 or less.

(2)

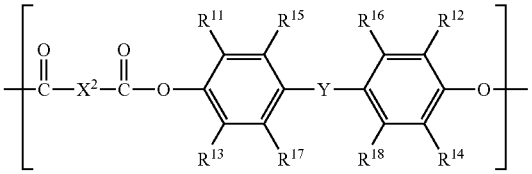

In the above formula (2), $R^{11}$ to $R^{18}$ each independently represent a hydrogen atom, a substituted or unsubstituted alkyl group, a substituted or unsubstituted aryl group or a substituted or unsubstituted alkoxy group; $X^2$ represents a divalent organic group; and Y represents a single bond, a substituted or unsubstituted alkylene group, a substituted or unsubstituted arylene group, an oxygen atom or a sulfur atom, (C)

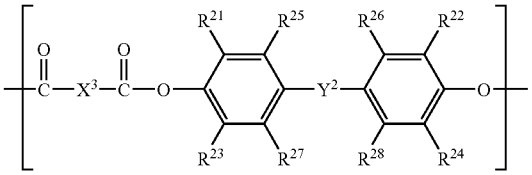

where, in formula (C), $R^{21}$ to $R^{28}$ each independently represent a hydrogen atom, a substituted or unsubstituted alkyl group, a substituted or unsubstituted aryl group or a substituted or unsubstituted alkoxy group; $X^3$ represents a divalent organic group; and $Y^2$ represents a single bond, a substituted or unsubstituted alkylene group, a substituted or unsubstituted arylene group, an oxygen atom or a sulfur atom, (D)

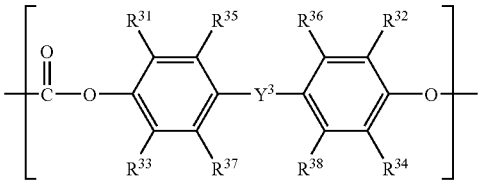

where, in formula (D), $R^{31}$ to $R^{38}$ each independently represent a hydrogen atom, a substituted or unsubstituted alkyl group, a substituted or unsubstituted aryl group or a substituted or unsubstituted alkoxy group; and $Y^3$ represents a single bond, a substituted or unsubstituted alkylene group, a substituted or unsubstituted arylene group, an oxygen atom or a sulfur atom.

In the above formula (1), $X^1$ represents a divalent organic group.

As the divalent organic group, for example, a substituted or unsubstituted alkylene group, a substituted or unsubstituted cycloalkylene group, a substituted or unsubstituted arylene group, a substituted or unsubstituted biphenylene group or a divalent group having a plurality of phenylene groups bonded via an alkylene group, an oxygen atom or a sulfur atom may be mentioned. Of these, a substituted or unsubstituted alkylene group, a substituted or unsubstituted arylene group, a divalent group having a plurality of phenylene groups bonded via an alkylene group, an oxygen atom or a sulfur atom is preferable.

As the alkylene group, an alkylene group having 3 or more and 10 or less carbon atoms constituting the main chain can be used. Examples thereof include a propylene group, a butylene group, a pentylene group, a hexylene group, a heptylene group, an octylene group, a nonylene group and decylene group. Of these, a butylene group and a hexylene group are preferable.

As the cycloalkylene group, a cycloalkylene group having 5 or more and 10 or less carbon atoms constituting the ring can be used. Examples thereof include a cyclopentylene group, a cyclohexylene group, a cycloheptylene group, a cyclooctylene group, a cyclononylene group and a cyclodecylene group. Of these, a cyclohexylene group is preferable.

As the arylene group, for example, a phenylene group (an o-phenylene group, an m-phenylene group and a p-phenylene group) and a naphthylene group may be mentioned. Of these, an m-phenylene group and a p-phenylene group are preferable.

As the divalent phenylene group having a plurality of phenylene groups bonded via an alkylene group, an oxygen atom or a sulfur atom, an o-phenylene group, an m-phenylene group and a p-phenylene group may be mentioned. Of these, a p-phenylene group is preferable. As the alkylene group for binding a plurality of phenylene groups, substituted or unsubstituted alkylene group having 1 or more and 4 or less carbon atoms constituting the main chain can be used. Of these, a methylene group and an ethylene group are preferable.

As the substituents that the aforementioned groups may have, for example, an alkyl group, an alkoxy group and an aryl group may be mentioned. Examples of the alkyl group include a methyl group, an ethyl group, a propyl group and a butyl group. Examples of the alkoxy group include a methoxy group, an ethoxy group, a propoxy group and a butoxy group. Examples of the aryl group include a phenyl group. Of these, a methyl group is preferable.

Now, specific examples of $X^1$ in the above formula (1) will be shown below.

(3-1) $-(CH_2)_3-$ (3-2) $-(CH_2)_4-$ (3-3) $-(CH_2)_5-$ (3-4) $-(CH_2)_6-$ (3-5) $-(CH_2)_7-$

-continued (3-6) $-(CH_2)_8-$ (3-7) $-(CH_2)_9-$ (3-8) $-(CH_2)_{10}-$ (3-9)

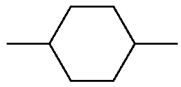

(3-10)

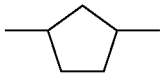

(3-11)

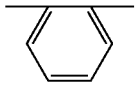

(3-12)

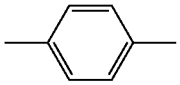

(3-13)

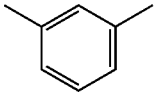

(3-14)

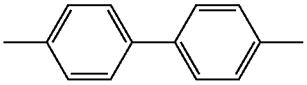

(3-15)

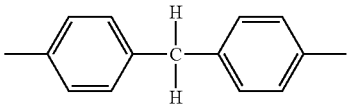

(3-16)

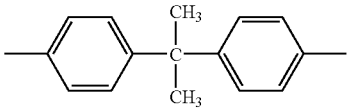

(3-17)

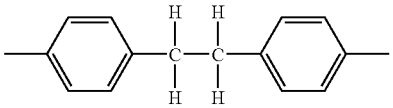

(3-18)

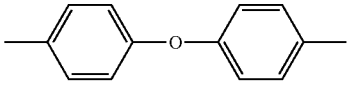

(3-19)

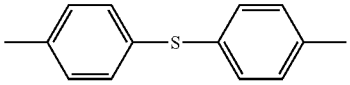

Of these, groups represented by the above formulas (3-2), (3-4), (3-12), (3-13) and (3-18) are preferable.

In the above formula (1), $X^1$ is not necessarily a single kind of group. To improve the solubility and mechanical strength of a polyester resin A, two groups or more may be used as $X^1$. For example, in the case where a group represented by the above formula (3-12) or (3-13) is used, use of another group in combination is preferable to single use in view of improvement of the solubility of a resin. When a group represented by the above formula (3-12) and a group represented by the above formula (3-13) are used in combination, the ratio (molar ratio) of a group represented by the above formula (3-12)

relative to a group represented by the above formula (3-13) in a polyester resin A is preferably 1:9 to 9:1 and more preferably 3:7 to 7:3.

In the above formula (1), $R^1$ and $R^2$ each independently represent a substituted or unsubstituted alkyl group or a substituted or unsubstituted aryl group.

Examples of the alkyl group include a methyl group, an ethyl group, a propyl group and a butyl group.

Examples of the aryl include a phenyl group.

Of these, $R^1$ and $R^2$ are preferably a methyl group in order to mitigate the contact stress.

In the above formula (1), Z represents substituted or unsubstituted alkylene group having 1 or more and 4 or less carbon atoms.

Examples of the alkylene group having 1 or more and or less carbon atoms include a methylene group, an ethylene group, a propylene group and a butylene group. Of these, a propylene is preferable in view of compatibility of a polyester resin A with a charge transporting material (degree of resistance to phase separation, the same applies to the following).

In the above formula (1), n represents an average number of repeats of a structure (—$SiR^1R^2$—O—) within the brackets and ranges from 20 or more and 150 or less. When n is 20 or more and 150 or less, a matrix-domain structure, which has a matrix formed of a charge transporting material and at least one of polyester resin C and polycarbonate resin D, and a domain formed of polyester resin A in the matrix, is efficiently formed. Particularly, it is preferred that n is 25 or more and 80 or less.

Specific examples of the repeating structural unit represented by the above formula (1) will be shown below.

(1-1)

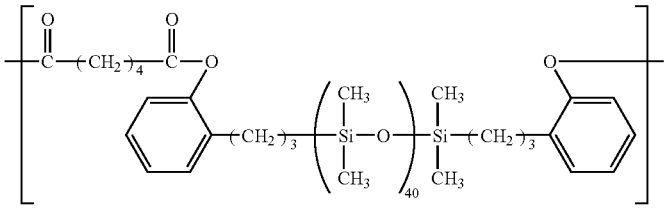

(1-2)

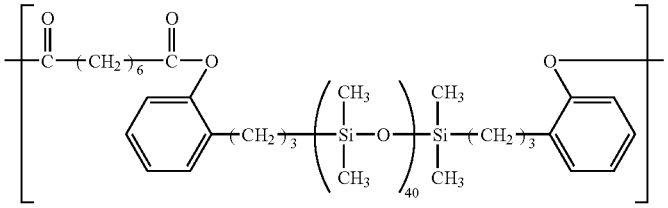

(1-3)

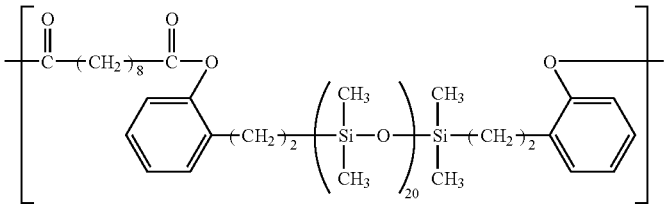

(1-4)

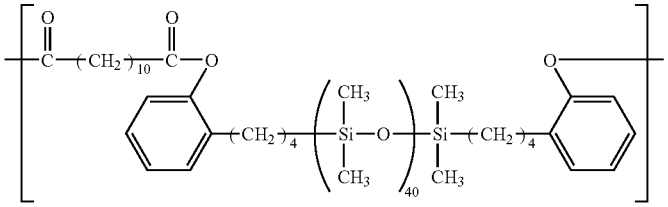

(1-5)

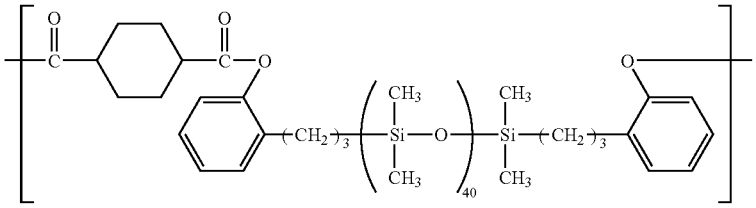

-continued
(1-6)
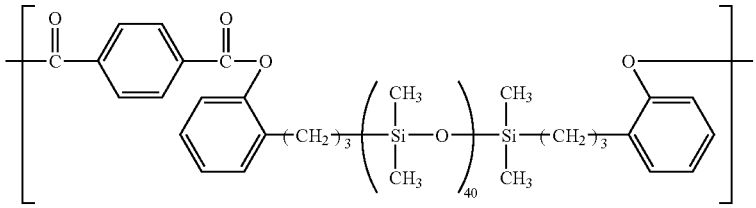
(1-7)
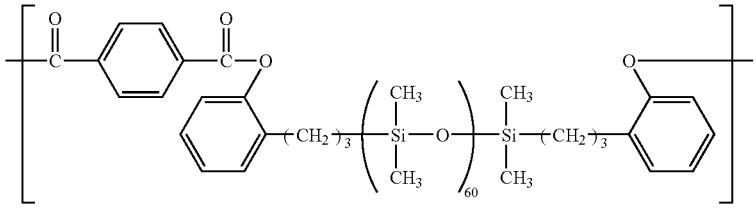
(1-8)
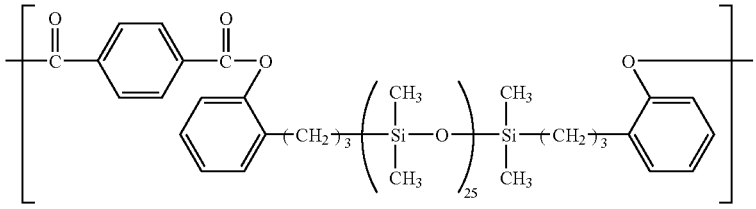
(1-9)
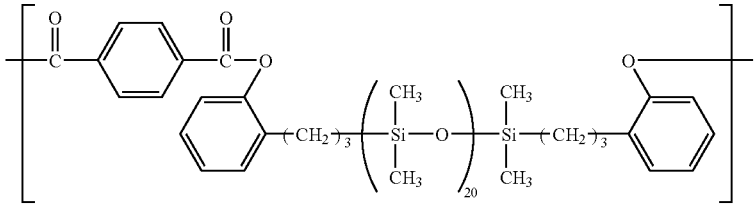
(1-10)
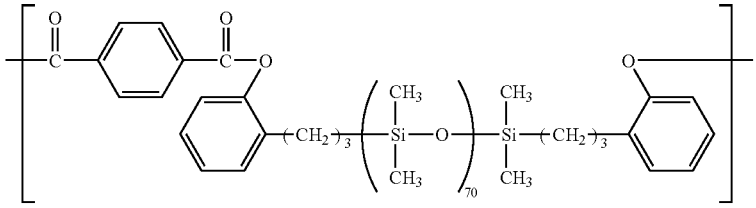
(1-11)
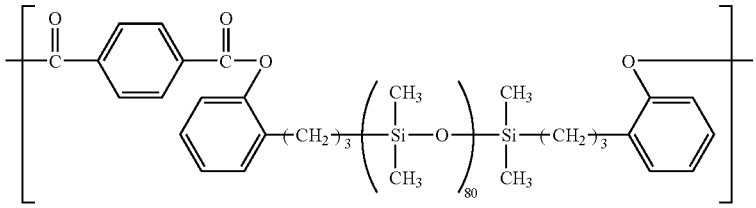
(1-12)
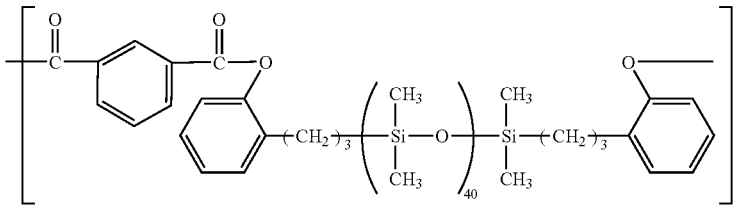

-continued
(1-13)
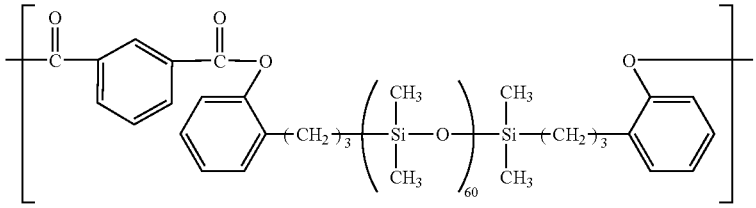
(1-14)
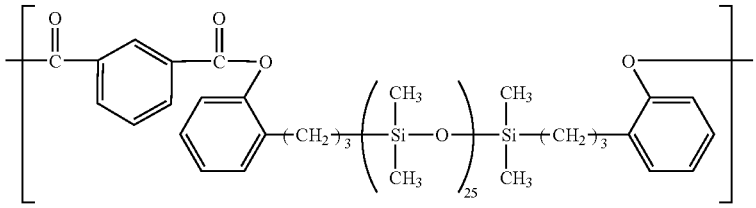
(1-15)
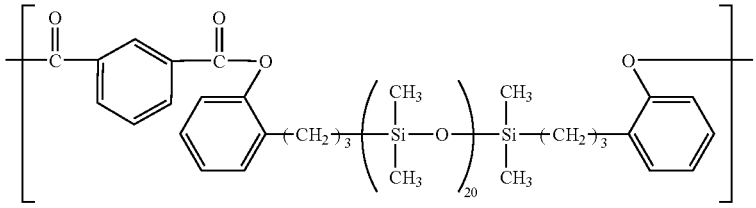
(1-16)
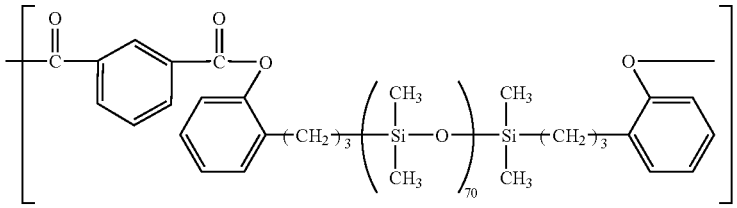
(1-17)
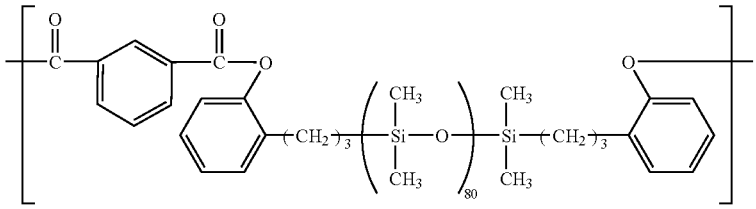
(1-18)
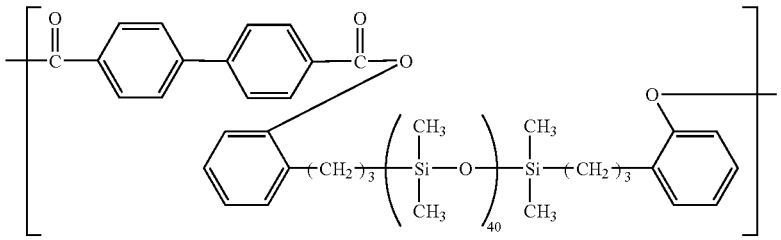
(1-19)
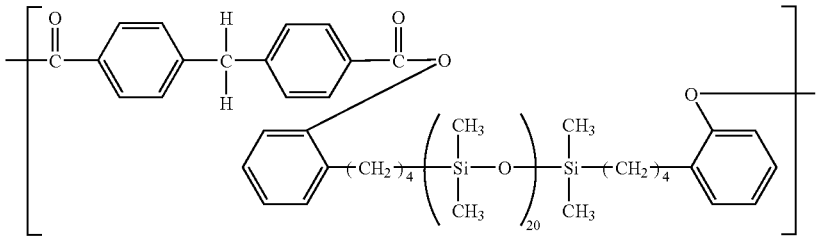

-continued
(1-20)
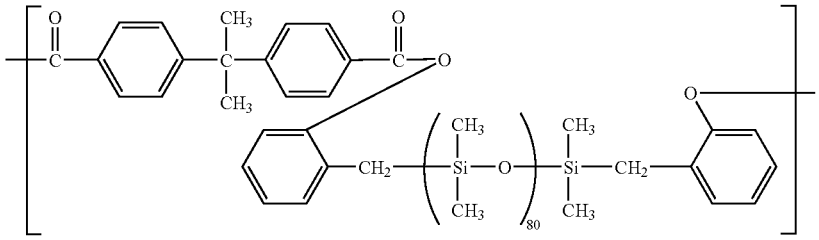
(1-21)
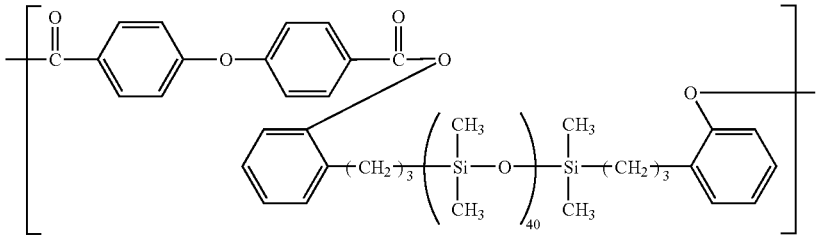
(1-22)
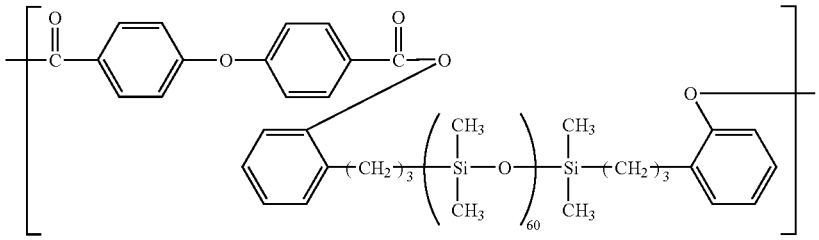
(1-23)
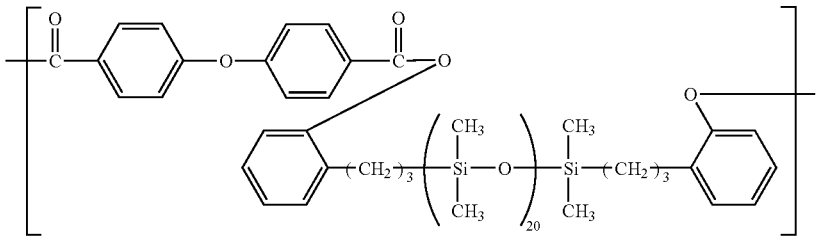
(1-24)
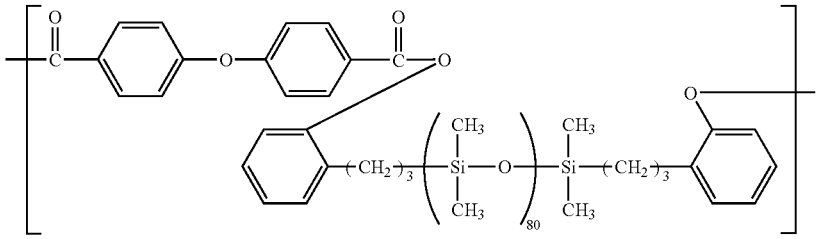
(1-25)
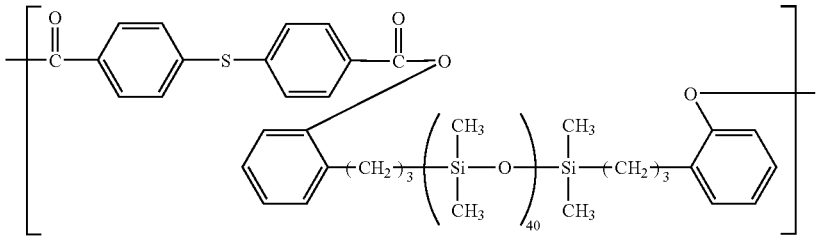

-continued
(1-26)
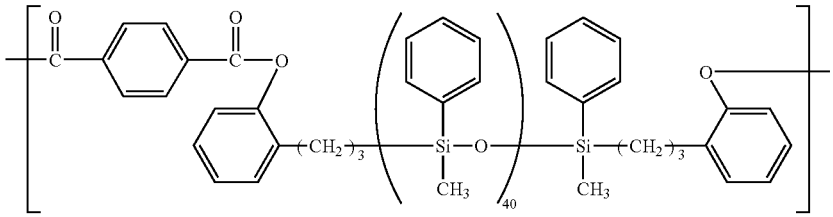
(1-27)
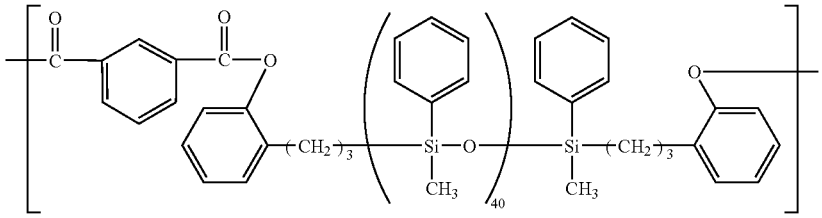
(1-28)
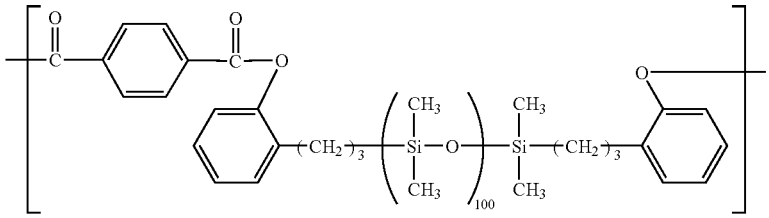
(1-29)
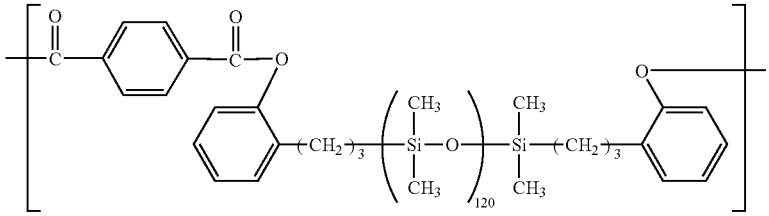
(1-30)
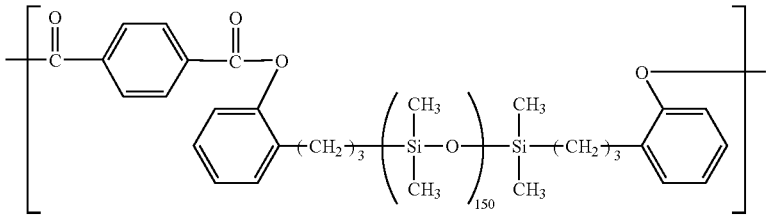
(1-31)
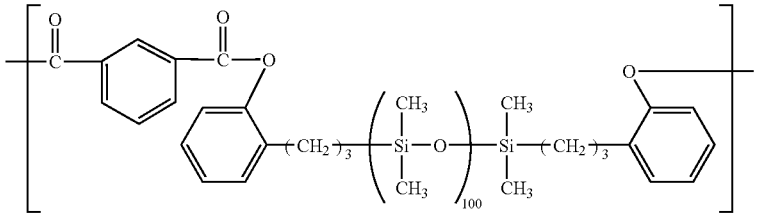
(1-32)
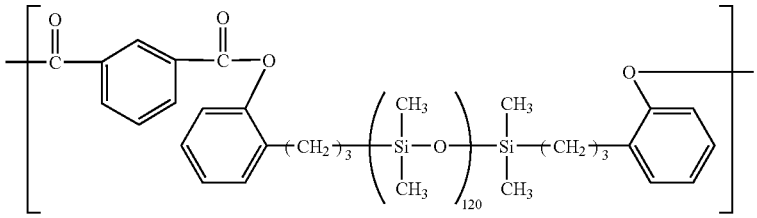

-continued (1-33)

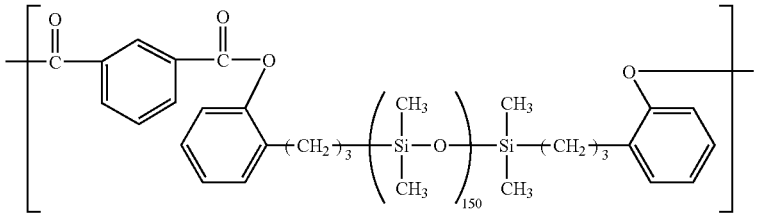

Of these, the repeating structural units represented by the above formulas (1-6), (1-7), (1-8), (I-10), (1-12), (1-13), (1-14), (1-16), (1-21) and (1-22) are preferable In the above formula (2), $R^{11}$ to $R^{18}$ each independently represent a hydrogen atom, a substituted or unsubstituted alkyl group, a substituted or unsubstituted aryl group or a substituted or unsubstituted alkoxy group.

As the alkyl group, for example, a methyl group, an ethyl group, a propyl group and a butyl group may be mentioned. As the aryl group, for example, a phenyl group and a naphthyl group may be mentioned. As the alkoxy group, a methoxy group, an ethoxy group, a propoxy group, and a butoxy group may be mentioned. Of these, a methyl group, an ethyl group, a methoxy group, an ethoxy group and a phenyl group are preferable, and a methyl group is more preferable.

In the above formula (2), $X^2$ represents a divalent organic group.

As the divalent organic group, a substituted or unsubstituted alkylene group, a substituted or unsubstituted cycloalkylene group, a substituted or unsubstituted arylene group, a substituted or unsubstituted biphenylene group or a divalent group having a plurality of phenylene groups bonded via an alkylene group, an oxygen atom or a sulfur atom may be mentioned. Of these, a substituted or unsubstituted alkylene group, a substituted or unsubstituted arylene group, and a divalent group having a plurality of phenylene groups bonded via an alkylene group, an oxygen atom or a sulfur atom are preferable.

As the alkylene group, an alkylene group having 3 or more and 10 or less carbon atoms constituting the main chain is preferable. Examples thereof include a propylene group, a butylene group, a pentylene group, a hexylene group, a heptylene group, an octylene group, a nonylene group and a decylene group. Of these, a butylene group and a hexylene group are preferable.

As the cycloalkylene group, a cycloalkylene group having 5 or more and 10 or less carbon atoms constituting the ring is preferable. Examples thereof include a cyclopentylene group, a cyclohexylene group, a cycloheptylene group, a cyclooctylene group, a cyclononylene group and a cyclodecylene group. Of these, a cyclohexylene group is preferable.

As the arylene group, for example, a phenylene group (an o-phenylene group, an m-phenylene group and a p-phenylene group) and a naphthylene group may be mentioned. Of these, an m-phenylene group and a p-phenylene group are preferable.

As the phenylene groups of the divalent group having a plurality of phenylene groups bonded via an alkylene group, an oxygen atom or a sulfur atom, an o-phenylene group, an m-phenylene group and a p-phenylene group may be mentioned. Of these, a p-phenylene group is preferable. As the alkylene group for binding a plurality of phenylene groups, a substituted or unsubstituted alkylene group having 1 or more and 4 or less carbon atoms constituting the main chain is preferable. Of these, a methylene group and an ethylene group are preferable.

As the substituents that the aforementioned groups may each have, for example, an alkyl group, an alkoxy group and an aryl group may be mentioned. As the alkyl group, for example, a methyl group, an ethyl group, a propyl group and a butyl group may be mentioned. As the alkoxy group, for example, a methoxy group, an ethoxy group, a propoxy group and a butoxy group may be mentioned. As the aryl group, for example, a phenyl group may be mentioned. Of these, a methyl group is preferable.

In the above formula (2), as the specific examples of $X^2$, the same examples as those for $X^1$ in the above formula (1) may be mentioned. Of them, groups represented by the above formulas (3-2), (3-4), (3-12), (3-13) and (3-18) are preferable.

In the above formula (2), Y represents a single bond, a substituted or unsubstituted alkylene group, a substituted or unsubstituted arylene group, an oxygen atom or a sulfur atom.

As the alkylene group, an alkylene group having 1 or more and 4 or less carbon atoms constituting the main chain is preferable. Examples of thereof include a methylene group, an ethylene group, a propylene group and a butylene group may be mentioned. Of these, a methylene group is preferable in view of mechanical strength.

As the arylene group, for example, a phenylene group (an o-phenylene group, an m-phenylene group and a p-phenylene group), a biphenylene group and a naphthylene group may be mentioned.

As the substituents that the aforementioned groups may each have, for example, an alkyl group, an alkoxy group and an aryl may be mentioned. As the alkyl group, for example, a methyl group, an ethyl group, a propyl group and a butyl group may be mentioned. As the alkoxy group, for example, a methoxy group, an ethoxy group, a propoxy group and a butoxy group may be mentioned. As the aryl group, for example, a phenyl group may be mentioned.

In the above formula (2), Y is preferably a substituted or unsubstituted methylene group. Of them, a group represented by the following formula (5) is more preferable.

(5)

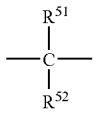

In the above formula (5), $R^{51}$ and $R^{52}$ each independently represent a hydrogen atom, a substituted or unsubstituted alkyl group, a substituted or unsubstituted aryl group or a substituted or unsubstituted alkoxy group; or $R^{51}$ and $R^{52}$ are joined to form a substituted or unsubstituted cycloalkylidene group or fluorenylidene group.

As the alkyl group, for example, a methyl group, an ethyl group, a propyl group and a butyl group may be mentioned. Of these, a methyl group is preferable. Furthermore, of the alkyl groups, as a substituted alkyl group, for example, fluoroalkyl groups such as a trifluoromethyl group and a pentafluoroethyl group may be mentioned.

As the aryl group, for example, a phenyl group and a naphthyl group may be mentioned.

As the alkoxy group, for example, a methoxy group, an ethoxy group, a propoxy group and a butoxy group may be mentioned.

As the cycloalkylidene group, for example, a cyclopentylidene group, a cyclohexylidene group and a cycloheptylidene group may be mentioned. Of these, a cycloheptylidene group is preferable.

Specific examples of the group represented by the above formula (5) are shown below.

(5-1)

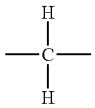

(5-2)

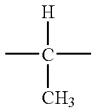

(5-3)

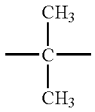

-continued (5-4)

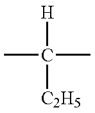

(5-5)

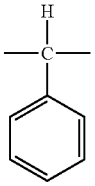

(5-6)

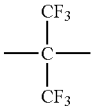

(5-7)

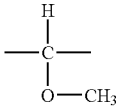

(5-8)

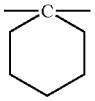

Of these, the groups represented by the above formula (5-1), (5-2), (5-3) and (5-8) are preferable.

Specific examples of the repeating structural unit represented by the above formula (2) are shown below.

(2-1)

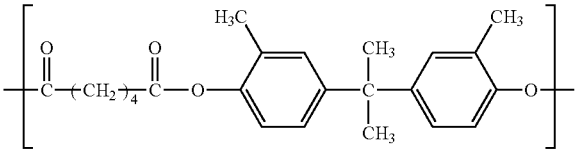

(2-2)

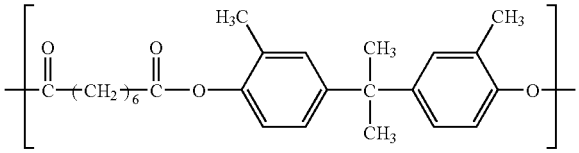

(2-3)

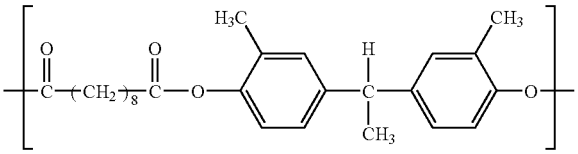

(2-4)

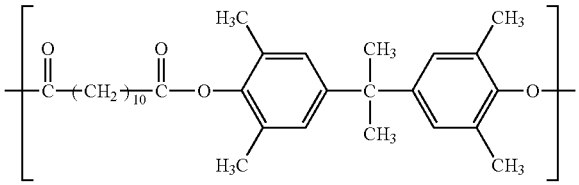

(2-5)

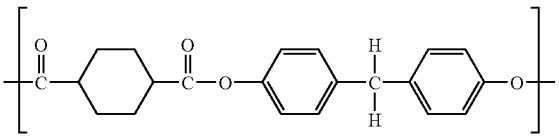

(2-6)

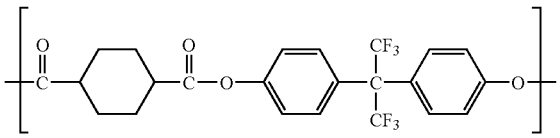

-continued
(2-7)
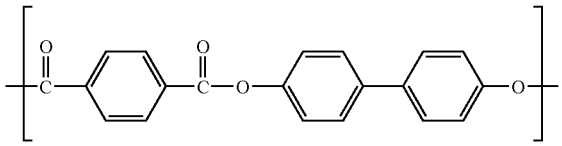
(2-8)
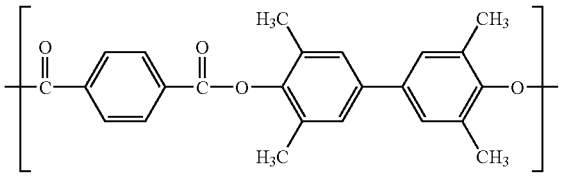
(2-9)
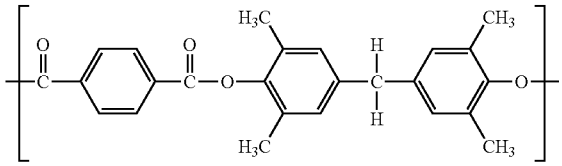
(2-10)
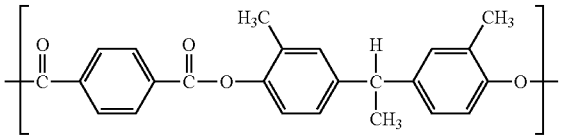
(2-11)
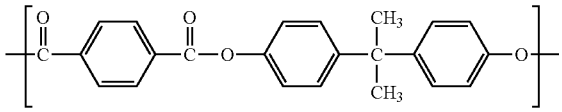
(2-12)
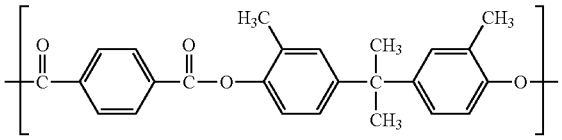
(2-13)
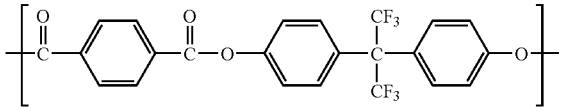
(2-14)
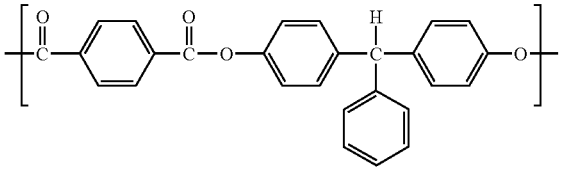
(2-15)
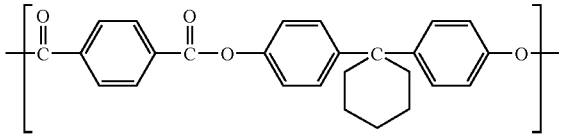
(2-16)
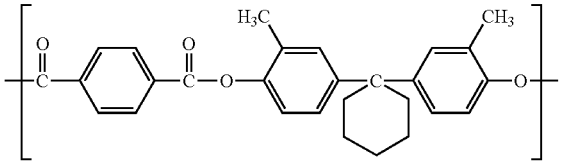
(2-17)
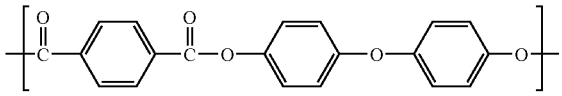
(2-18)
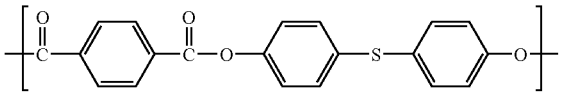
(2-19)
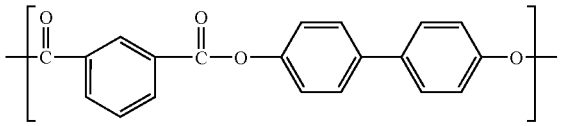
(2-20)
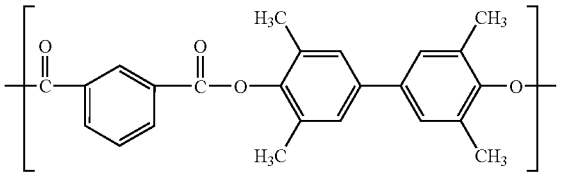
(2-21)
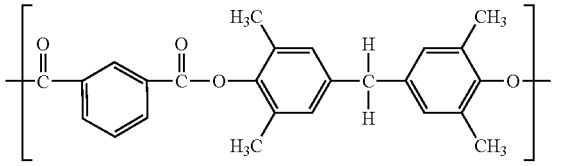
(2-22)
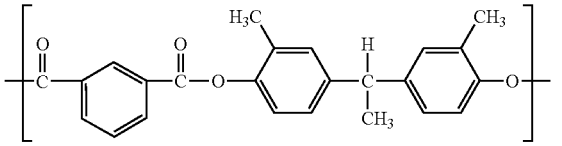

-continued
(2-23)
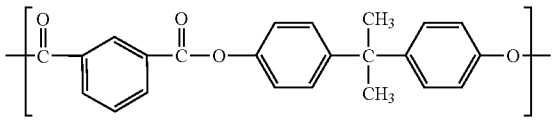
(2-24)
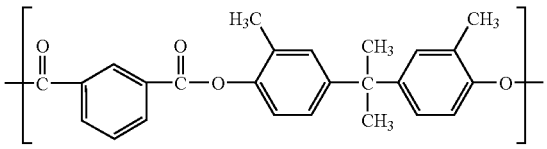
(2-25)
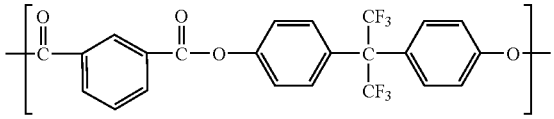
(2-26)
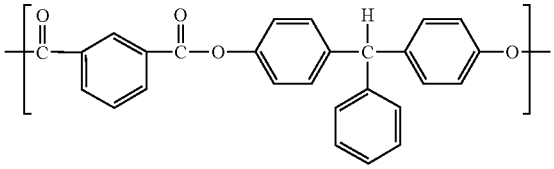
(2-27)
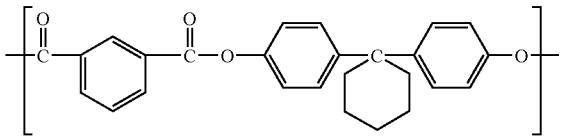
(2-28)
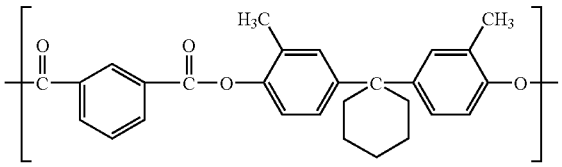
(2-29)
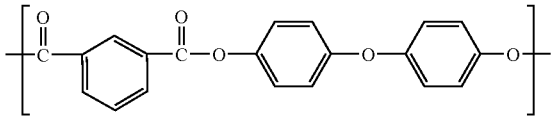
(2-30)
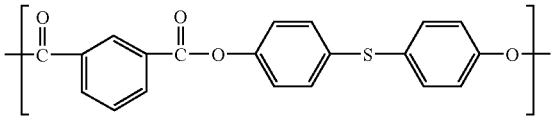
(2-31)
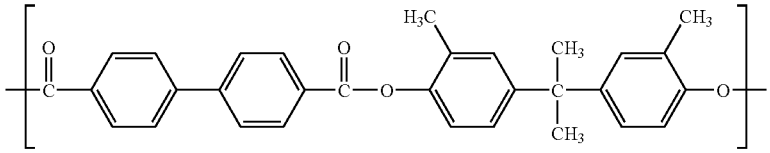
(2-32)
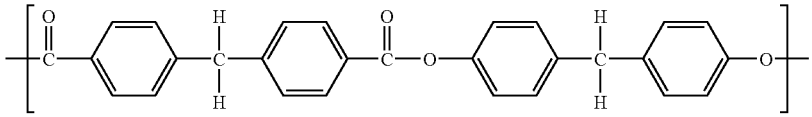
(2-33)
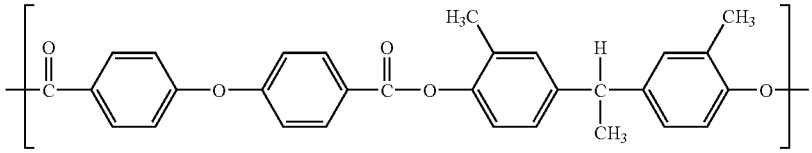
(2-34)
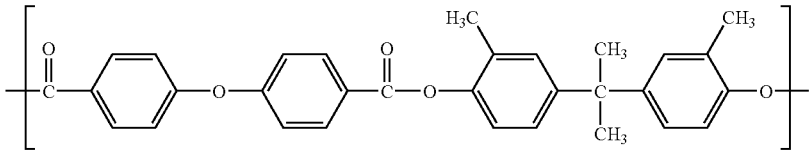
(2-35)
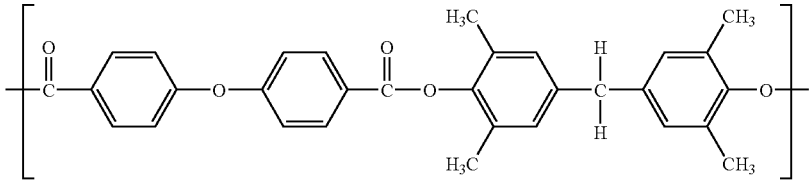

-continued (2-36)

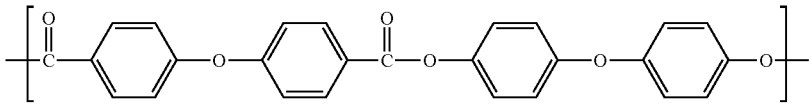

(2-37)

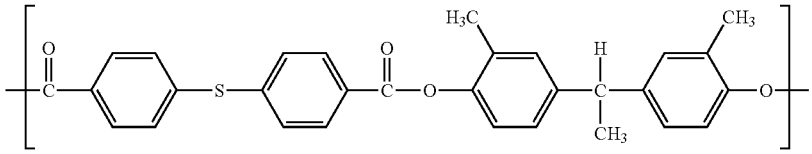

(2-38)

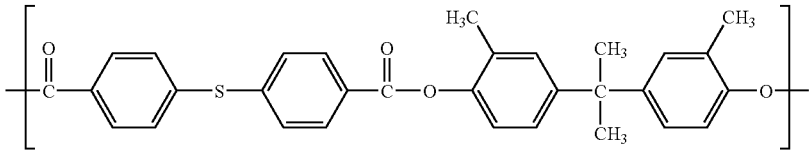

(2-39)

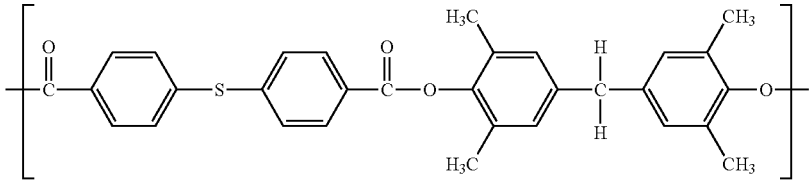

(2-40)

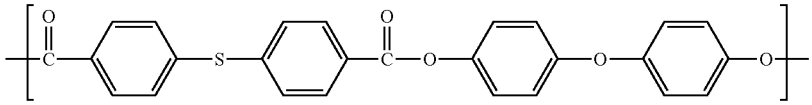

Of these, the repeating structural units represented by the above formulas (2-1), (2-2), (2-8), (2-9), (2-10), (2-12), (2-17), (2-20), (2-21), (2-22), (2-24), (2-29), (2-33), (2-34) and (2-35) are preferable.

Furthermore, polyester resin A of the present invention is a polyester resin containing a siloxane moiety in an amount of not less than 10% by mass and not more than 40% by mass relative to the total mass of polyester resin A.

In the present invention, the siloxane moiety refers to a moiety containing silicon atoms at both ends constituting a siloxane portion and the groups binding to them, an oxygen atom sandwiched by the silicon atoms at the both ends, the silicon atoms and the groups binding to them. More specifically, the siloxane moiety in the present invention, for example, in the case of the repeating structural unit represented by the following formula (1-6-s), refers to the site surrounded by the broken line shown below.

When the content of the siloxane moiety relative to the total mass of polyester resin A of the present invention is not less than 10% by mass, an effect of mitigating contact stress is persistently exerted, and a domain can be efficiently formed in the matrix formed of a charge transporting material and at least one of polyester resin C and polycarbonate resin D. Furthermore, when the content of the siloxane moiety is not more than 40% by mass, formation of aggregates of the charge transporting material in the domain formed of polyester resin A is suppressed, thereby suppressing potential change.

The content of the siloxane moiety relative to the total mass of the polyester resin A of the present invention can be analyzed by a general analysis method. Examples of the analysis method are shown below.

After the charge transport layer serving as the surface layer of an electrophotographic photosensitive member is dis- (1-6-s)

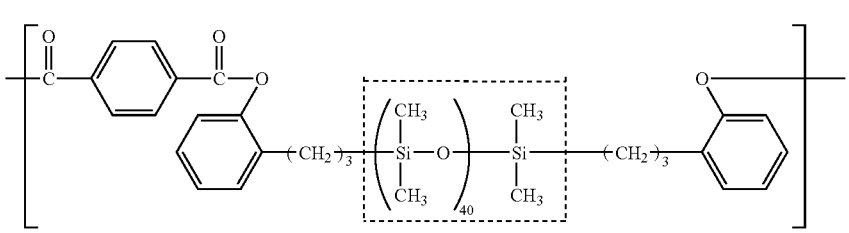

solved in a solvent, various types of materials contained in the charge transport layer serving as the surface layer are separated by a separation apparatus capable of separating and recovering components, such as size exclusion chromatography and high performance liquid chromatography. The polyester resin A thus separated is hydrolyzed in the presence of alkali and decomposed into a carboxylic acid portion and a bisphenol portion. The bisphenol portion obtained is subjected to nuclear magnetic resonance spectrum analysis and mass spectrometry to calculate the number of repetitions in the siloxane portion and a molar ratio thereof, and computationally convert them into a content (mass ratio).

The above polyester resin A to be used in the present invention is a copolymer formed of a repeating structural unit represented by the above formula (1) and a repeating structural unit represented by the above formula (2). The copolymerization form may be any one of block copolymerization, random copolymerization and alternating copolymerization. Particularly, random copolymerization is preferable.

The weight average molecular weight of polyester resin A to be used in the present invention is preferably 30,000 or more and 200,000 or less in order to form a domain in the matrix formed of a charge transporting material and at least one of polyester resin C and polycarbonate resin D. Furthermore, the weight average molecular weight is more preferably 40,000 or more and 150,000 or less.

In the present invention, the weight average molecular weight of a resin refers to a weight average molecular weight converted in terms of polystyrene measured according to a customary method as shown below.

More specifically, the resin to be measured was put in tetrahydrofuran and allowed to stand still for several hours. Thereafter, the resin to be measured and tetrahydrofuran were sufficiently mixed while stirring and allowed to stand further for 12 hours or more. Thereafter, the mixture was passed through a sample treatment filter (My-Shori Disc H-25-5, manufactured by Tohso Corporation) to obtain a sample for GPC (gel permeation chromatography).

Subsequently, a column was stabilized in a heat chamber of 40° C. To the column of this temperature, tetrahydrofuran was poured as a solvent at a flow rate of 1 ml per minute, and the GPC sample (10 μl) obtained above was poured. As the column, the column, TSKgel Super HM-M (manufactured by Tohso Corporation) was used.

In measuring the weight average molecular weight of the resin to be measured, the molecular weight distribution of the resin to be measured was calculated based on the relationship between a logarithmic value of a calibration curve, which is prepared by using a plurality of monodispersed polystyrene standard samples, and a count number. As the polystyrene standard samples used in preparing the calibration curve, ten monodispersed polystyrene samples (manufactured by Aldrich) having a molecular weight of 3,500, 12,000, 40,000, 75,000, 98,000, 120,000, 240,000, 500,000, 800,000 and 1,800,000 in total were used. As a detector, an RI (refractive index) detector was used.

The copolymerization ratio of the aforementioned polyester resin A to be used in the present invention can be confirmed by a general method, that is, a conversion method based on the peak area ratio of hydrogen atoms (hydrogen atoms constituting the resin) obtained by $^1$H-NMR measurement of a resin.

The above polyester resin A to be used in the present invention can be synthesized, for example, by a transesterification method between a dicarboxylic ester and a diol compound. Alternatively, the polyester resin can be synthesized by a polymerization reaction between a divalent acid halide such as dicarboxylic acid halide and a diol compound.

Subsequently, polyester resin C having a repeating structural unit represented by the above formula (C) will be described.

In the above formula (C), $R^{21}$ to $R^{28}$ each independently represent a hydrogen atom, a substituted or unsubstituted alkyl group, a substituted or unsubstituted aryl group or a substituted or unsubstituted alkoxy group.

As the alkyl group, for example, a methyl group, an ethyl group, a propyl group and a butyl group may be mentioned. As the aryl group, for example, a phenyl group and a naphthyl group may be mentioned. As the alkoxy group, for example, a methoxy group, an ethoxy group, a propoxy group and a butoxy group may be mentioned. Of these, a methyl group, an ethyl group, a methoxy group, an ethoxy group and a phenyl group are preferable, and a methyl group is more preferable.

In the above formula (C), $X^3$ represents a divalent organic group.

As the divalent organic group, for example, a substituted or unsubstituted arylene group, a substituted or unsubstituted biphenylene group or a divalent group having a plurality of phenylene groups bonded via an alkylene group, an oxygen atom or a sulfur atom may be mentioned. Of these, a substituted or unsubstituted arylene group, a divalent group having a plurality of phenylene groups bonded via an alkylene group, an oxygen atom or a sulfur atom is preferable.

As the arylene group, for example, a phenylene group (an o-phenylene group, an m-phenylene group and a p-phenylene group) and a naphthylene group may be mentioned. Of these, an m-phenylene group and a p-phenylene group are preferable.

As the divalent phenylene group having a plurality of phenylene groups bonded via an alkylene group, an oxygen atom or a sulfur atom, for example, an o-phenylene group, an m-phenylene group and a p-phenylene group may be mentioned. Of these, a p-phenylene group is preferable. As the alkylene group for binding a plurality of phenylene groups, substituted or unsubstituted alkylene group having 1 or more and 4 or less carbon atoms constituting the main chain can be used. Of these, a methylene group and an ethylene group are preferable.

As the substituents that the aforementioned groups may have, for example, an alkyl group, an alkoxy group and an aryl group may be mentioned. Examples of the alkyl group include a methyl group, an ethyl group, a propyl group and a butyl group. Examples of the alkoxy group include a methoxy group, an ethoxy group, a propoxy group and a butoxy group. Examples of the aryl group include a phenyl group. Of these, a methyl group is preferable.

In the above formula (C), as the specific examples of $X^3$, the same examples as those for $X^1$ in the above formula (1) may be mentioned. Of them, groups represented by the above formulas (3-12), (3-13) and (3-18) are preferable.

In the above formula (C), $Y^2$ represents a single bond, a substituted or unsubstituted alkylene group, a substituted or unsubstituted arylene group, an oxygen atom or a sulfur atom.

As the alkylene group, an alkylene group having 1 or more and 4 or less carbon atoms constituting the main chain is preferable. Examples thereof include a methylene group, an ethylene group, a propylene group and a butylene group. Of these, a methylene group is preferable in view of mechanical strength.

As the arylene group, for example, a phenylene group (an o-phenylene group, an m-phenylene group and a p-phenylene group), a biphenylene group and a naphthylene group may be mentioned.

As the substituents that the aforementioned groups may have, for example, an alkyl group, an alkoxy group and an aryl group may be mentioned. Examples of the alkyl group include a methyl group, an ethyl group, a propyl group and a butyl group. Examples of the alkoxy group include a methoxy group, an ethoxy group, a propoxy group and a butoxy group. Examples of the aryl group include a phenyl group.

In the above formula (C), $Y^2$ is preferably a substituted or unsubstituted methylene group. Of them, a group represented by the above formula (5) is more preferable. Of these, groups represented by the above formulas (5-1), (5-2), (5-3) and (5-8) are preferable.

Specific examples of the repeating structural unit represented by the above formula (C) may include the repeating structural units represented by the above formulas (2-7) to (2-40).

Of them, the repeating structural units represented by the above formulas (2-8), (2-9), (2-10), (2-12), (2-17), (2-20), (2-21), (2-22), (2-24), (2-29), (2-33), (2-34) and (2-35) are preferable.

Subsequently, polycarbonate resin D having a repeating structural unit represented by the above formula (D) will be described.

In the above formula (D), $R^{31}$ to $R^{38}$ each independently represent a hydrogen atom, a substituted or unsubstituted alkyl group, a substituted or unsubstituted aryl group or a substituted or unsubstituted alkoxy group.

As the alkyl group, for example, a methyl group, an ethyl group, a propyl group and a butyl group may be mentioned. As the aryl group, for example, a phenyl group and a naphthyl group may be mentioned. As the alkoxy group, for example, a methoxy group, an ethoxy group, a propoxy group and a butoxy group may be mentioned. Of these, a methyl group, an ethyl group, a methoxy group, an ethoxy group and a phenyl group are preferable, and a methyl group is more preferable.

In the above formula (D), $Y^3$ represents a single bond, a substituted or unsubstituted alkylene group, a substituted or unsubstituted arylene group, an oxygen atom or a sulfur atom.

As the alkylene group, an alkylene group having 1 or more and 4 or less carbon atoms constituting the main chain can be used. Examples thereof include a methylene group, an ethylene group, a propylene group and a butylene group. Of these, a methylene group is preferable in view of mechanical strength.

As the arylene group, for example, a phenylene group (an o-phenylene group, an m-phenylene group and a p-phenylene group), a biphenylene group and a naphthylene group may be mentioned.

As the substituents that the aforementioned groups may have, for example, an alkyl group, an alkoxy group and an aryl group may be mentioned. Examples of the alkyl group include a methyl group, an ethyl group, a propyl group and a butyl group. Examples of the alkoxy group include a methoxy group, an ethoxy group, a propoxy group and a butoxy group. Examples of the aryl group include a phenyl group.

In the above formula (C), $Y^3$ is preferably a substituted or unsubstituted methylene group. Of them, a group represented by the above formula (5) is more preferable. Of these, groups represented by the above formulas (5-1), (5-2), (5-3) and (5-8) are preferable.

Specific examples of the repeating structural unit of the polycarbonate resin D having the repeating structural unit represented by the above formula (D) will be shown below.

(9-1)

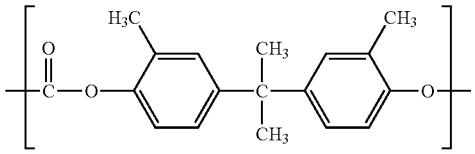

(9-2)

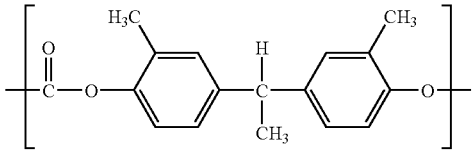

(9-3)

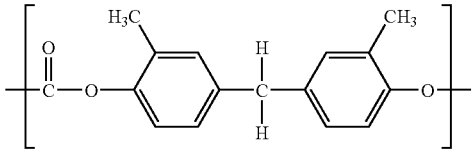

(9-4)

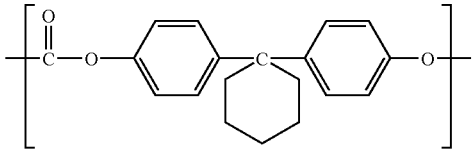

(9-5)

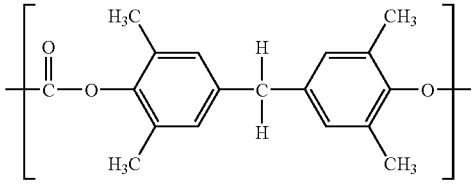

(9-6)

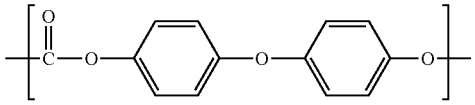

Of them, the repeating structural units represented by the above formulas (9-1), (9-4) and (9-6) are preferable.

The charge transport layer in the present invention has a matrix-domain structure having a matrix formed of a charge transporting material and at least one of polyester resin C and polycarbonate resin D, and a domain formed of polyester resin A in the matrix. The matrix-domain structure in the present invention is like a "sea-island structure" where the sea corresponds to the matrix and the island corresponds to the domain.

The domain formed of polyester resin A refers to a particulate (island) structure formed in the matrix, which is formed of a charge transporting material and at least one of polyester resin C and polycarbonate resin D. The domains formed of polyester resin A are independently present in the matrix. Such a matrix-domain structure can be confirmed by observing the surface and the section of a charge transport layer.

Observation of the matrix-domain structure or measurement of domains, can be made, for example, by a commercially available laser microscope, an optical microscope, an electron microscope and an atomic force microscope.

As the laser microscope, for example, instruments such as an ultra-depth profile measuring microscope VK-8550 (manufactured by Keyence Corporation), an ultra-depth profile measuring microscope VK-9000 (manufactured by Keyence Corporation), an ultra-depth profile measuring microscope VK-9500 (manufactured by Keyence Corporation), a surface profile measuring system, Surface Explorer SX-520DR type instrument (manufactured by Ryoka Systems Inc.), a scanning type confocal laser microscope OLS3000 (manufactured by Olympus Corporation) and a real color confocal microscope optics C130 (manufactured by Lasertec Corporation) are available.

As the optical microscope, for example, instruments such as a digital microscope VHX-500 (manufactured by Keyence Corporation), a digital microscope VHX-200 (manufactured by Keyence Corporation) and a 3D digital microscope VC-7700 (manufactured by Omron Corporation) are available.

As the electron microscope, for example, instruments such as a 3D real surface view microscope VE-9800 (manufactured by Keyence Corporation), a 3D real surface view microscope VE-8800 (manufactured by Keyence Corporation), a scanning electron microscope conventional/Variable Pressure SEM (manufactured by SII NanoTechnology Inc.), a scanning electron microscope SUPERSCAN SS-550 (manufactured by Shimadzu Corporation) are available.

As the interatomic force microscope, for example, instruments such as a nano-scale hybrid microscope VN-8000 (manufactured by Keyence Corporation), a scanning probe microscope NanoNavi station (manufactured by SII NanoTechnology Inc.) and a scanning probe microscope SPM-9600 (manufactured by Shimadzu Corporation) are available.

Using the aforementioned microscope, the state of the matrix-domain structure can be observed or the number of domains can be counted at a predetermined magnification.

Number average particle size of domains formed of polyester resin A of the present invention is preferably 100 nm or more and 500 nm or less. Furthermore, the particle-size distribution of domains is preferably narrow in order to obtain a uniform coating film and obtain uniform effect of mitigating stress.

The number average particle size of the present invention is calculated by selecting 100 domains at random from those microscopically observed in a longitudinal section of the charge transport layer of the present invention and taking an average of the maximum diameters of the domains.

To form the matrix-domain structure in the present invention, the content of the siloxane moiety in polyester resin A is preferably not less than 1% by mass and not more than 20% by mass relative to the total mass of the resin (whole binder resin) of the charge transport layer. Furthermore, to satisfy mitigation of the contact stress and potential stability during repeated use in balance, the content of the siloxane moiety in polyester resin A is preferably not less than 1% by mass and not more than 20% by mass relative to the total mass of the resin (whole binder resin) of the charge transport layer. Furthermore, not less than 2% by mass and not more than 10% by mass is more preferable. This is because mitigation of contact stress and potential stability during repeated use can be further improved.

The matrix-domain structure of the charge transport layer in the electrophotographic photosensitive member of the present invention can be formed by use of a charge-transporting layer coating solution containing a charge transporting material, polyester resin A, and at least one of polyester resin C and polycarbonate resin D. Furthermore, the matrix-domain structure can be also formed by forming a film of a coating solution containing only polyester resin A forming a domain and at least one of polyester resin C and polycarbonate resin D for forming a matrix. On the other hand, when a film is formed by use of a coating solution containing a charge transporting material and a polyester resin containing a siloxane moiety, the charge transporting material may sometimes form aggregates in the polyester resin containing a siloxane moiety. In the matrix-domain structure in the present invention differs from the state where aggregates of the charge transporting material are formed. In the electrophotographic photosensitive member of the present invention having a charge transport layer having a matrix-domain structure, which has a matrix formed of a charge transporting material and at least one of polyester resin C and polycarbonate resin D, and a domain formed of polyester resin A formed in the matrix, potential characteristics can be stably maintained. The reasons for this have not yet elucidated; however, the present inventors consider that this may be caused by the following phenomena.

To describe more specifically, the matrix-domain structure of the present invention is a structure where a domain is formed of polyester resin A (or a siloxane moiety contained in the polyester resin A) in a matrix formed of a charge transporting material and at least one of polyester resin C and polycarbonate resin D. In this case, since the matrix is formed of a charge transporting material and at least one of polyester resin C and polycarbonate resin D, satisfactory charge transporting ability can be maintained. Furthermore, if no aggregates of a charge transporting material are observed in the domain formed of polyester resin A, it is considered that a decrease of the charge transporting ability by aggregation of the charge transporting material may not be caused. Furthermore, it is considered that the effect of mitigating stress is persistently exerted by formation of a domain formed of polyester resin A in the transporting layer.

Synthesis Examples of the above polyester resin A to be used in the present invention will be described below.

Synthesis Example 1

Synthesis of Polyester Resin A (A1) Having Repeating Structural Units Represented by the Above Formulas (1-6), (1-12), (2-12) and (2-24)

Dicarboxylic acid halide (24.6 g) represented by the following formula (6-1):

(6-1)

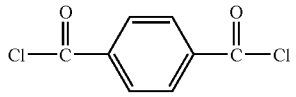

and dicarboxylic acid halide (24.6 g) represented by the following formula (6-2):

(6-2)

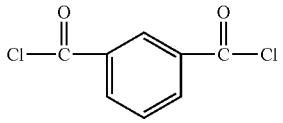

were dissolved in dichloromethane to prepare an acid halide solution.

Furthermore, separately from the acid halide solution, a diol (21.7 g) having a siloxane structure represented by the following formula (7-1):

(7-1)

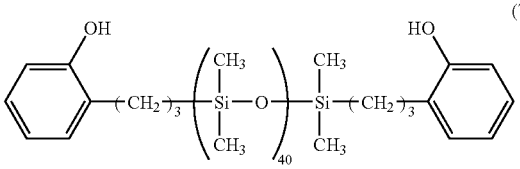

and a diol (43.9 g) represented by the following formula (8-1):

(8-1)

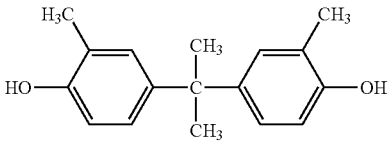

were dissolved in a 10% aqueous sodium hydroxide solution. Furthermore, tributylbenzyl ammonium chloride was added as a polymerization catalyst and stirred to prepare a diol compound solution.

Next, the above acid halide solution was added to the above diol compound solution while stirring to initiate polymerization. The polymerization was performed for 3 hours with stirring while the reaction temperature was maintained at 25° C. or less.

Thereafter, acetic acid was added to terminate the polymerization reaction. Washing with water was repeated until the water phase was neutralized. After washing, the resultant solution was added dropwise to methanol under stirring to precipitate a polymer. The polymer was dried under vacuum to obtain polyester resin A (A1) (80 g) having repeating structural units represented by the above formulas (1-6), (1-12), (2-12) and (2-24). This is shown in Table 1.

As the content of the siloxane moiety in polyester resin A (A1) was calculated as described above, it was 20% by mass. Furthermore, the weight average molecular weight of polyester resin A (A1) was 130,000.

Synthesis Examples 2 to 7

Synthesis of Polyester Resins A (A2 to A7) Having Repeating Structural Units Represented by the Above Formulas (1-6), (1-12), (2-12) and (2-24)

Use amounts of dicarboxylic acid halides (6-1) and (6-2) and the diol compounds (7-1) and (8-1) used in Synthesis Example 1 in synthesizing were controlled to synthesize polyester resins A (A2 to A7) shown in Table 1.

Furthermore, the contents of the siloxane moieties in polyester resins A (A2 to A7) were calculated in the same manner as in Synthesis Example 1 and shown in Table 1.

Furthermore, the weight average molecular weights of the polyester resins A (A2 to A7) were measured in the same manner as in Synthesis Example 1. The weight average molecular weights were respectively:

polyester resin A (A2): 120,000 polyester resin A (A3): 100,000 polyester resin A (A4): 80,000 polyester resin A (A5): 130,000 polyester resin A (A6): 150,000 polyester resin A (A7): 160,000.

Synthesis Example 8

Synthesis of Polyester Resin A (B1) Having Repeating Structural Units Represented by the Above Formulas (1-7), (1-13), (2-12) and (2-24)

Dicarboxylic acid halide (24.4 g) represented by the above formula (6-1) and dicarboxylic acid halide (24.4 g) represented by the above formula (6-2) were dissolved in dichloromethane to prepare an acid halide solution.

Furthermore, separately from the acid halide solution, using diol (21.0 g) having the siloxane structure represented by the following formula (7-2):

(7-2)

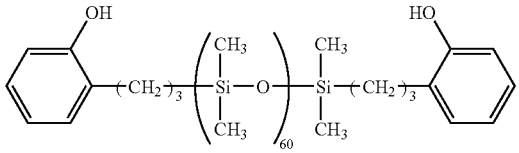

and diol (44.2 g) represented by the above formula (8-1), the same operation as in Synthesis Example 1 was performed to obtain polyester resin A (B1) (70 g) having repeating structural units represented by, the above formulas (1-7), (1-13), (2-12) and (2-24). This is shown in Table 1.

Furthermore, the content of the siloxane moiety of polyester resin A (B1) was calculated in the same manner as in Synthesis Example 1 and shown in Table 1.

Furthermore, the weight average molecular weight of polyester resin A (B1) was measured in the same manner as in Synthesis Example 1. The weight average molecular weight of polyester resin A (B1) was 125,000.

Synthesis Examples 9 to 11

Synthesis of polyester resins A (B2 to B4) having Repeating Structural Units Represented by the Above Formulas (1-7), (1-13), (2-12) and (2-24)

Use amounts of dicarboxylic acid halides (6-1) and (6-2) and the diol compounds (7-2) and (8-1) used in Synthesis Example 8 in synthesizing were controlled to synthesize polyester resins A (B2 to B4) shown in Table 1.

Furthermore, the contents of siloxane moieties of polyester resins A (B2 to B4) were calculated in the same manner as in Synthesis Example 1, and shown in Table 1.

Furthermore, the weight average molecular weights of polyester resin A (B2 to B4) were measured in the same manner as in Synthesis Example 1. The weight average molecular weights were respectively:

polyester resin A (B2): 130,000 polyester resin A (B3): 90,000 polyester resin A (B4): 140,000

Synthesis Example 12

Synthesis of Polyester Resin A (C) Having Repeating Structural Units Represented by the Above Formulas (1-8), (1-14), (2-9) and (2-21)

Dicarboxylic acid halide (24.9 g) represented by the above formula (6-1) and dicarboxylic acid halide (24.9 g) represented by the above formula (6-2) were dissolved in dichloromethane to prepare an acid halide solution.

Furthermore, separately from the acid halide solution, using diol (21.8 g) having the siloxane structure represented by the following formula (7-3):

(7-3)

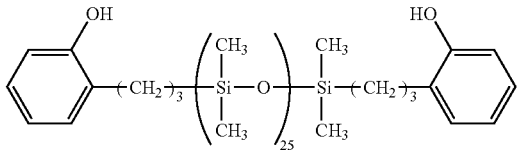

and diol (43.5 g) represented by the following formula (8-2):

(8-2)

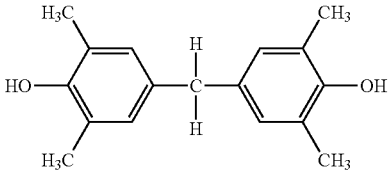

the same operation as in Synthesis Example 1 was performed to obtain polyester resin A (C) (70 g) having repeating structural units represented by the above formulas (1-8), (1-14), (2-9) and (2-21). This is shown in Table 1.

Furthermore, the content of the siloxane moiety in polyester resin A (C) was calculated in the same manner as in Synthesis Example 1 and shown in Table 1.

Furthermore, weight average molecular weight of polyester resin A (C) was measured in the same manner as in Synthesis Example 1. the weight average molecular weight was 120,000.

Synthesis Example 13

Synthesis of Polyester Resin A (D) Having Repeating Structural Units Represented by the Above Formulas (1-9), (1-15), (2-15) and (2-27)

Dicarboxylic acid halide (24.0 g) represented by the above formula (6-1) and dicarboxylic acid halide (24.0 g) represented by the above formula (6-2) were dissolved in dichloromethane to prepare an acid halide solution.

Furthermore, separately from the acid halide solution, using diol (23.5 g) having the siloxane structure represented by the following formula (7-4):

(7-4)

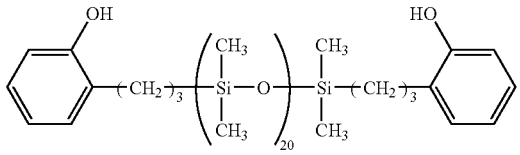

and diol (44.5 g) represented by the following formula (8-3):

(8-3)

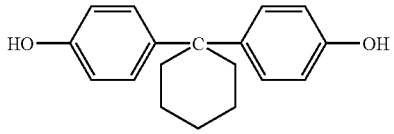

the same operation as in Synthesis Example 1 was performed to obtain polyester resin A (D) (70 g) having repeating structural units represented by the above formulas (1-9), (1-15), (2-15) and (2-27). This is shown in Table 1.

Furthermore, the content of a siloxane moiety in polyester resin A (D) was calculated in the same manner as in Synthesis Example 1 and shown in Table 1.

Furthermore, the weight average molecular weight of polyester resin A (D) was measured in the same manner as in Synthesis Example 1. The weight average molecular weight was 100,000.

Synthesis Example 14

Synthesis of Polyester Resin A (E) Having Repeating Structural Units Represented by the Above Formulas (1-10), (1-16), (2-7) and (2-19)

Dicarboxylic acid halide (28.0 g) represented by the above formula (6-1) and dicarboxylic acid halide (28.0 g) represented by the above formula (6-2) were dissolved in dichloromethane to prepare an acid halide solution.

Furthermore, separately from the acid halide solution, using diol (21.3 g) having the siloxane structure represented by the following formula (7-5):

(7-5)

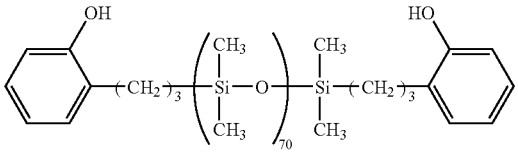

and diol (38.4 g) represented by the following formula (8-4):

(8-4)

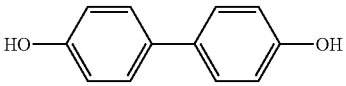

the same operation as in Synthesis Example 1 was performed to obtain polyester resin A (E) (60 g) having repeating structural units represented by the above formulas (1-10), (1-16), (2-7) and (2-19). This is shown in Table 1.

Furthermore, the content of a siloxane moiety in polyester resin A (E) was calculated in the same manner as in Synthesis Example 1 and shown in Table 1.

Furthermore, the weight average molecular weight of polyester resin A (E) was measured in the same manner as in Synthesis Example 1. The weight average molecular weight was 150,000.

Synthesis Example 15

Synthesis of Polyester Resin A (F1) Having Repeating Structural Units Represented by the Above Formulas (1-11), (1-17), (2-12) and (2-24)

Dicarboxylic acid halide (24.3 g) represented by the above formula (6-1) and dicarboxylic acid halide (24.3 g) represented by the above formula (6-2) were dissolved in dichloromethane to prepare an acid halide solution.

Furthermore, separately from the acid halide solution, using diol (20.6 g) having the siloxane structure represented by the following formula (7-6):

(7-6)

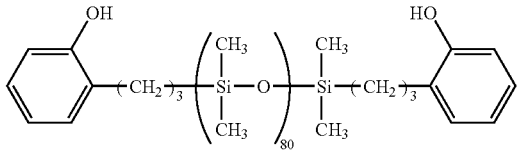

and diol (44.3 g) represented by the above formula (8-1), the same operation as in Synthesis Example 1 was performed to obtain polyester resin A (F1) (60 g) having repeating structural units represented by the above formulas (1-11), (1-17), (2-12) and (2-24). This is shown in Table 1.

Furthermore, the content of a siloxane moiety in polyester resin A (F1) was calculated in the same manner as in Synthesis Example 1 and shown in Table 1.

Furthermore, the weight average molecular weight of polyester resin A (F1) was measured in the same manner as in Synthesis Example 1. The weight average molecular weight was 140,000.

Synthesis Examples 16 and 17

Synthesis of Polyester Resin A (F2 and F3) Having Repeating Structural Units Represented by the Above Formulas (1-11), (1-17), (2-12) and (2-24)

The polyester resin A (F2 and F3) shown in Table 1 was synthesized by controlling the use amount of dicarboxylic acid halides (6-1) and (6-2) and diol compounds (7-6) and (8-1) in synthesis of Synthesis Example 1.

Furthermore, the content of a siloxane moiety in polyester resin A (F2 and F3) was calculated in the same manner as in Synthesis Example 1 and shown in Table 1.

Furthermore, the weight average molecular weight of polyester resin A (F2 and F3) was measured in the same manner as in Synthesis Example 1. The weight average molecular weights were respectively:

polyester resin A (F2): 50,000 polyester resin A (F3): 40,000

Synthesis Example 18

Synthesis of Polyester Resin A (G) Having Repeating Structural Units Represented by the Above Formulas (1-21) and (2-33)

Dicarboxylic acid halide (51.7 g) represented by the following formula (6-3):

(6-3)

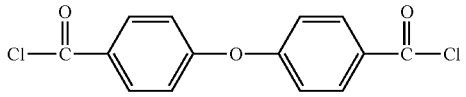

was dissolved in dichloromethane to prepare an acid halide solution.

Furthermore, separately from the acid halide solution, using diol (21.7 g) having a siloxane structure and represented by the above formula (7-1) and diol (40.6 g) represented by the following formula (8-5):

(8-5)

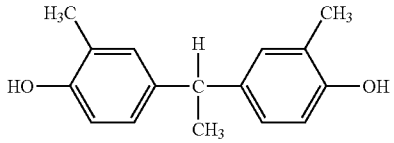

the same operation as in Synthesis Example 1 was performed to obtain polyester resin A (G) (70 g) having repeating structural units represented by the above formulas (1-21) and (2-33). This is shown in Table 1.

Furthermore, the content of a siloxane moiety in polyester resin A (G) was calculated in the same manner as in Synthesis Example 1 and shown in Table 1.

Furthermore, the weight average molecular weight of polyester resin A (G) was measured in the same manner as in Synthesis Example 1. The weight average molecular weight was 120,000.

Synthesis Example 19

Synthesis of Polyester Resin A (H) Having Repeating Structural Units Represented by the Above Formulas (1-22) and (2-33)

Dicarboxylic acid halide (51.4 g) represented by the above formula (6-3) was dissolved in dichloromethane to prepare an acid halide solution.

Furthermore, separately from the acid halide solution, using diol (21.0 g) having a siloxane structure and represented by the above formula (7-2) and diol (41.2 g) represented by the above formula (8-5), the same operation as in Synthesis Example 1 was performed to obtain polyester resin A (H) (65 g) having repeating structural units represented by the above formulas (1-22) and (2-33). This is shown in Table 1.

Furthermore, the content of a siloxane moiety in polyester resin A (H) was calculated in the same manner as in Synthesis Example 1 and shown in Table 1.

Furthermore, the weight average molecular weight of polyester resin A (H) was measured in the same manner as in Synthesis Example 1. The weight average molecular weight was 130,000.

Synthesis Example 20

Synthesis of Polyester Resin A (I) Having Repeating Structural Units Represented by the Above Formulas (1-23) and (2-33)

Dicarboxylic acid halide (52.7 g) represented by the above formula (6-3) was dissolved in dichloromethane to prepare an acid halide solution.

Furthermore, separately from the acid halide solution, using diol (23.5 g) having a siloxane structure and represented by the above formula (7-4) and diol (40.2 g) represented by the above formula (8-5), the same operation as in Synthesis Example 1 was performed to obtain polyester resin A (I) (60 g) having repeating structural units represented by the above formulas (1-23) and (2-33). This is shown in Table 1.

Furthermore, the content of a siloxane moiety in polyester resin A (I) was calculated in the same manner as in Synthesis Example 1 and shown in Table 1.

Furthermore, the weight average molecular weight of polyester resin A (I) was measured in the same manner as in Synthesis Example 1. The weight average molecular weight was 110,000.

Synthesis Example 21

Synthesis of Polyester Resin A (J) Having Repeating Structural Units Represented by the Above Formulas (1-24) and (2-33)

Dicarboxylic acid halide (51.2 g) represented by the above formula (6-3) was dissolved in dichloromethane to prepare an acid halide solution.

Furthermore, separately from the acid halide solution, using diol (20.6 g) having a siloxane structure and represented by the above formula (7-6) and diol (41.3 g) represented by the above formula (8-5), the same operation as in Synthesis Example 1 was performed to obtain polyester resin A (J) (60 g) having repeating structural units represented by the above formulas (1-23) and (2-33). This is shown in Table 1.

Furthermore, the content of a siloxane moiety in polyester resin A (J) was calculated in the same manner as in Synthesis Example 1 and shown in Table 1.

Furthermore, the weight average molecular weight of polyester resin A (J) was measured in the same manner as in Synthesis Example 1. The weight average molecular weight was 160,000.

Synthesis Example 22

Synthesis of Polyester Resin A (K) Having Repeating Structural Units Represented by the Above Formulas (1-21), (1-12), (2-34) and (2-24)

Dicarboxylic acid halide (34.6 g) represented by the above formula (6-3) and dicarboxylic acid halide (15.4 g) represented by the above formula (6-2) were dissolved in dichloromethane to prepare an acid halide solution.

Furthermore, separately from the acid halide solution, using diol (21.7 g) represented by the above formula (7-1) and diol (42.7 g) represented by the above formula (8-1), the same operation as in Synthesis Example 1 was performed to obtain polyester resin A (K) (65 g) having repeating structural units represented by the above formulas (1-21), (1-12), (2-34) and (2-24). This is shown in Table 1.

Furthermore, the content of a siloxane moiety in polyester resin A (K) was calculated in the same manner as in Synthesis Example 1 and shown in Table 1.

Furthermore, the weight average molecular weight of polyester resin A (K) was measured in the same manner as in Synthesis Example 1. The weight average molecular weight was 120,000.

Synthesis Example 23

Synthesis of Polyester Resin A (L) Having Repeating Structural Units Represented by the Above Formulas (1-22), (1-13), (2-34) and (2-24)

Dicarboxylic acid halide (34.3 g) represented by the above formula (6-3) and dicarboxylic acid halide (15.1 g) represented by the above formula (6-2) were dissolved in dichloromethane to prepare an acid halide solution.

Furthermore, separately from the acid halide solution, using diol (21.0 g) having a siloxane structure and represented by the above formula (7-2) and diol (43.0 g) represented by the above formula (8-1), the same operation as in Synthesis Example 1 was performed to obtain polyester resin A (L) (60 g) having repeating structural units represented by the above formulas (1-22), (1-13), (2-34) and (2-24). This is shown in Table 1.

Furthermore, the content of a siloxane moiety in polyester resin A (L) was calculated in the same manner as in Synthesis Example 1 and shown in Table 1.

Furthermore, the weight average molecular weight of polyester resin A (L) was measured in the same manner as in Synthesis Example 1. The weight average molecular weight was 125,000.

Synthesis Example 24

Synthesis of Polyester Resin A (M) Having Repeating Structural Units Represented by the Above Formulas (1-23), (1-15), (2-34) and (2-24)

Dicarboxylic acid halide (35.4 g) represented by the above formula (6-3) and dicarboxylic acid halide (15.5 g) represented by the above formula (6-2) were dissolved in dichloromethane to prepare an acid halide solution.

Furthermore, separately from the acid halide solution, using diol (23.5 g) having a siloxane structure and represented by the above formula (7-4) and diol (42.0 g) represented by the above formula (8-1), the same operation as in Synthesis Example 1 was performed to obtain polyester resin A (M) (60 g) having repeating structural units represented by the above formulas (1-23), (1-15), (2-34) and (2-24). This is shown in Table 1.

Furthermore, the content of a siloxane moiety in polyester resin A (M) was calculated in the same manner as in Synthesis Example 1 and shown in Table 1.

Furthermore, the weight average molecular weight of polyester resin A (M) was measured in the same manner as in Synthesis Example 1. The weight average molecular weight was 95,000.

Synthesis Example 25

Synthesis of Polyester Resin A (N) Having Repeating Structural Units Represented by the Above Formulas (1-24), (1-17), (2-34) and (2-24)

Dicarboxylic acid halide (34.2 g) represented by the above formula (6-3) and dicarboxylic acid halide (15.1 g) represented by the above formula (6-2) were dissolved in dichloromethane to prepare an acid halide solution.

Furthermore, separately from the acid halide solution, using diol (20.6 g) having a siloxane structure and represented by the above formula (7-6) and diol (34.2 g) represented by the above formula (8-1), the same operation as in Synthesis Example 1 was performed to obtain polyester resin A (N) (60 g) having repeating structural units represented by the above formulas (1-24), (1-17), (2-34) and (2-24). This is shown in Table 1.

Furthermore, the content of a siloxane moiety in polyester resin A (N) was calculated in the same manner as in Synthesis Example 1 and shown in Table 1.

Furthermore, the weight average molecular weight of polyester resin A (N) was measured in the same manner as in Synthesis Example 1. The weight average molecular weight was 155,000.

Synthesis Example 26

Synthesis of Polyester Resin A (O) Having Repeating Structural Units Represented by the Above Formulas (1-1) and (2-1)

Dicarboxylic acid halide (40.6 g) represented by the following formula (6-4):

(6-4)

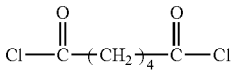

was dissolved in dichloromethane to prepare an acid halide solution.

Furthermore, separately from the acid halide solution, using diol (21.7 g) having a siloxane structure and represented by the above formula (7-1) and diol (55.4 g) represented by the above formula (8-1), the same operation as in Synthesis Example 1 was performed to obtain polyester resin A (O) (65 g) having repeating structural units represented by the above formulas (1-1) and (2-1). This is shown in Table 1.

Furthermore, the content of a siloxane moiety in polyester resin A (O) was calculated in the same manner as in Synthesis Example 1 and shown in Table 1.

Furthermore, the weight average molecular weight of polyester resin A (O) was measured in the same manner as in Synthesis Example 1. The weight average molecular weight was 105,000.

Synthesis Example 27

Synthesis of Polyester Resin A (P) Having Repeating Structural Units Represented by the Above Formulas (1-2) and (2-2)

Dicarboxylic acid halide (42.7 g) represented by the following formula (6-5):

(6-5)

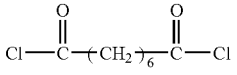

was dissolved in dichloromethane to prepare an acid halide solution.

Furthermore, separately from the acid halide solution, using diol (21.7 g) having an siloxane structure represented by the above formula (7-1) and diol (52.0 g) represented by the above formula (8-1), the same operation as in Synthesis Example 1 was performed to obtain polyester resin A (P) (60 g) having repeating structural units represented by the above formulas (1-1) and (2-1). This is shown in Table 1.

Furthermore, the content of a siloxane moiety in polyester resin A (P) was calculated in the same manner as in Synthesis Example 1 and shown in Table 1.

Furthermore, the weight average molecular weight of polyester resin A (P) was measured in the same manner as in Synthesis Example 1. The weight average molecular weight was 140,000.

Synthesis Example 28

Synthesis of Polyester Resin A (Q) Having Repeating Structural Units Represented by the Above Formulas (1-1), (1-12), (2-1) and (2-24)

Dicarboxylic acid halide (16.0 g) represented by the above formula (6-4) and dicarboxylic acid halide (31.5 g) represented by the above formula (6-2) were dissolved in dichloromethane to prepare an acid halide solution.

Furthermore, separately from the acid halide solution, using diol (21.7 g) having a siloxane structure and represented by the above formula (7-1) and diol (47.2 g) represented by the above formula (8-1), the same operation as in Synthesis Example 1 was performed to obtain polyester resin A (Q) (65 g) having repeating structural units represented by the above formulas (1-1), (1-12), (2-1) and (2-24). This is shown in Table 1.

Furthermore, the content of a siloxane moiety in polyester resin A (Q) was calculated in the same manner as in Synthesis Example 1 and shown in Table 1.

Furthermore, the weight average molecular weight of polyester resin A (Q) was measured in the same manner as in Synthesis Example 1. The weight average molecular weight was 120,000.

Synthesis Example 29

Synthesis of Polyester Resin A (R) Having Repeating Structural Units Represented by the Above Formulas (1-2), (1-12), (2-2) and (2-24)

Dicarboxylic acid halide (15.2 g) represented by the above formula (6-5) and dicarboxylic acid halide (32.4 g) represented by the above formula (6-2) were dissolved in dichloromethane to prepare an acid halide solution.

Furthermore, separately from the acid halide solution, using diol (21.7 g) having a siloxane structure and represented by the above formula (7-1) and diol (46.3 g) represented by the above formula (8-1), the same operation as in Synthesis Example 1 was performed to obtain polyester resin A (R) (60 g) having repeating structural units represented by the above formulas (1-2), (1-12), (2-2) and (2-24). This is shown in Table 1.

Furthermore, the content of a siloxane moiety in polyester resin A (R) was calculated in the same manner as in Synthesis Example 1 and shown in Table 1.

Furthermore, the weight average molecular weight of polyester resin A (R) was measured in the same manner as in Synthesis Example 1. The weight average molecular weight was 130,000.

Synthesis Example 30

Synthesis of Polyester Resin A (S) Having Repeating Structural Units Represented by the Above Formulas (1-30), (1-33), (2-2) and (2-24)

The above formula (6-1) and the above formula (6-2) used in Synthesis Example 1 were used as dicarboxylic acid halide, and, as diol, the following formula (7-7):

(7-7)

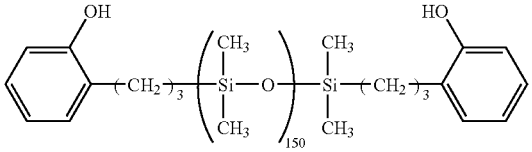

and the above formula (8-1) were used and the use amounts in synthesis were controlled to synthesize polyester resin A (S, weight average molecular weight 60,000) having repeating structural units represented by the above formula (1-30), (1-33), (2-22) and (2-24) and containing a siloxane moiety of 10% by mass based on the total mass of polyester resin A (S).

Synthesis Example 31

Synthesis of Polyester Resin A (T3) Having Repeating Structural Units Represented by the Above Formulas (1-28), (1-31), (2-2) and (2-24)

The above formula (6-1) and the above formula (6-2) used in Synthesis Example 1 were used as dicarboxylic acid halide, and, as diol, the following formula (7-9):

(7-9)

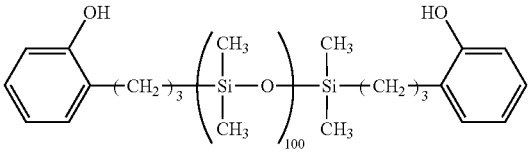

and the above formula (8-1) were used and the use amounts in synthesis were controlled to synthesize polyester resin A (T3, weight average molecular weight 50,000) having repeating structural units represented by the above formulas (1-28), (1-31), (2-2) and (2-24) and containing a siloxane moiety of 10% by mass based on the total mass of polyester resin A (T3).

TABLE 1

| | Polyester resin A | Repeating structural unit represented by formula (1) | Repeating structural unit represented by formula (2) | Content (% by mass) of siloxane moiety in polyester resin |
|---|---|---|---|---|
| Synthesis Example 1 | Polyester resin A(A1) | (1-6)/(1-12) = 5/5 | (2-12)/(2-24) = 5/5 | 20 |
| Synthesis Example 2 | Polyester resin A(A2) | (1-6)/(1-12) = 7/3 | (2-12)/(2-24) = 7/3 | 20 |
| Synthesis Example 3 | Polyester resin A(A3) | (1-6)/(1-12) = 3/7 | (2-12)/(2-24) = 3/7 | 20 |
| Synthesis Example 4 | Polyester resin A(A4) | (1-6)/(1-12) = 9/1 | (2-12)/(2-24) = 9/1 | 20 |
| Synthesis Example 5 | Polyester resin A(A5) | (1-6)/(1-12) = 5/5 | (2-12)/(2-24) = 5/5 | 25 |
| Synthesis Example 6 | Polyester resin A(A6) | (1-6)/(1-12) = 5/5 | (2-12)/(2-24) = 5/5 | 30 |
| Synthesis Example 7 | Polyester resin A(A7) | (1-6)/(1-12) = 5/5 | (2-12)/(2-24) = 5/5 | 40 |
| Synthesis Example 8 | Polyester resin A(B1) | (1-7)/(1-13) = 5/5 | (2-12)/(2-24) = 5/5 | 20 |
| Synthesis Example 9 | Polyester resin A(B2) | (1-7)/(1-13) = 5/5 | (2-12)/(2-24) = 5/5 | 30 |
| Synthesis Example 10 | Polyester resin A(B3) | (1-7)/(1-13) = 5/5 | (2-12)/(2-24) = 5/5 | 10 |
| Synthesis Example 11 | Polyester resin A(B4) | (1-7)/(1-13) = 5/5 | (2-12)/(2-24) = 5/5 | 5 |
| Synthesis Example 12 | Polyester resin A(C) | (1-8)/(1-14) = 5/5 | (2-9)/(2-21) = 5/5 | 20 |
| Synthesis Example 13 | Polyester resin A(D) | (1-9)/(1-15) = 5/5 | (2-15)/(2-27) = 5/5 | 20 |
| Synthesis Example 14 | Polyester resin A(E) | (1-10)/(1-16) = 5/5 | (2-7)/(2-19) = 5/5 | 20 |
| Synthesis Example 15 | Polyester resin A(F1) | (1-11)/(1-17) = 5/5 | (2-12)/(2-24) = 5/5 | 20 |
| Synthesis Example 16 | Polyester resin A(F2) | (1-11)/(1-17) = 5/5 | (2-12)/(2-24) = 5/5 | 10 |
| Synthesis Example 17 | Polyester resin A(F3) | (1-11)/(1-17) = 5/5 | (2-12)/(2-24) = 5/5 | 5 |
| Synthesis Example 18 | Polyester resin A(G) | (1-21) | (2-33) | 20 |
| Synthesis Example 19 | Polyester resin A(H) | (1-22) | (2-33) | 20 |
| Synthesis Example 20 | Polyester resin A(I) | (1-23) | (2-33) | 20 |

TABLE 1-continued

| | Polyester resin A | Repeating structural unit represented by formula (1) | Repeating structural unit represented by formula (2) | Content (% by mass) of siloxane moiety in polyester resin |
|---|---|---|---|---|
| Synthesis Example 21 | Polyester resin A(J) | (1-24) | (2-33) | 20 |
| Synthesis Example 22 | Polyester resin A(K) | (1-21)/(1-12) = 7/3 | (2-34)/(2-24) = 7/3 | 20 |
| Synthesis Example 23 | Polyester resin A(L) | (1-22)/(1-13) = 7/3 | (2-34)/(2-24) = 7/3 | 20 |
| Synthesis Example 24 | Polyester resin A(M) | (1-23)/(1-15) = 7/3 | (2-34)/(2-24) = 7/3 | 20 |
| Synthesis Example 25 | Polyester resin A(N) | (1-24)/(1-17) = 7/3 | (2-34)/(2-24) = 7/3 | 20 |
| Synthesis Example 26 | Polyester resin A(O) | (1-1) | (2-1) | 20 |
| Synthesis Example 27 | Polyester resin A(P) | (1-2) | (2-2) | 20 |
| Synthesis Example 28 | Polyester resin A(Q) | (1-1)/(1-12) = 3/7 | (2-1)/(2-24) = 3/7 | 20 |
| Synthesis Example 29 | Polyester resin A(R) | (1-2)/(1-12) = 3/7 | (2-2)/(2-24) = 3/7 | 20 |
| Synthesis Example 30 | Polyester resin A(S) | (1-30)/(1-33) = 5/5 | (2-2)/(2-24) = 5/5 | 10 |
| Synthesis Example 31 | Polyester resin A(T3) | (1-28)/(1-31) = 5/5 | (2-2)/(2-24) = 5/5 | 10 |

The charge transport layer serving as the surface layer of the electrophotographic photosensitive member of the present invention contains a polyester resin A and at least one of polyester resin C and polycarbonate resin D. Another resin may be blended and put in use.

Examples of another resin that may be blended include an acrylic resin, a styrene resin, a polyester resin, a polycarbonate resin, polysulfone resin, a polyphenyleneoxide resin, an epoxy resin, a polyurethane resin, an alkyd resin and an unsaturated resin.

Furthermore, it is preferred that polyester resin C and polycarbonate resin D do not have a repeating structural unit represented by the above formula (1) in order to efficiently form the above matrix-domain structure.

As a charge transporting material contained in the charge transport layer serving as the surface layer of the electrophotographic photosensitive member of the present invention, for example, a triarylamine compound, a hydrazone compound, a styryl compound, a stilbene compound, a pyrazoline compound, an oxazole compound, a thiazole compound and a triarylmethane compound may be mentioned. These charge transporting materials may be used alone or as a mixture of two types or more. Furthermore, of these, a triarylamine compound is preferably used as a charge transporting material in order to improve electrophotographic characteristics. Moreover, of the triarylamine compounds, it is preferred to use a compound represented by the following formula (4):

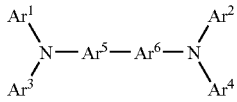

(4)

[In formula (4), $Ar^1$ to $Ar^4$ each independently represent a substituted or unsubstituted aryl group; and $Ar^5$ and $Ar^6$ each independently represent a substituted or unsubstituted arylene group].

In the above formula (4), $Ar^1$ to $Ar^4$ each independently represent a substituted or unsubstituted aryl group. As the aryl group, for example, a phenyl group and naphthyl group may be mentioned. Of these, a phenyl group is preferable. As a substituent that the aryl group may have, for example, an alkyl group, an aryl group, an alkoxy group and a monovalent group having an unsaturated bond may be mentioned.

In the above formula (4), $Ar^5$ and $Ar^6$ each independently represent a substituted or unsubstituted arylene group. As the arylene group, for example, a phenylene group and a naphthylene group may be mentioned. Of these, a phenylene group is preferable.

Examples of the compound represented by the above formula (4) are shown below.

(4-1)

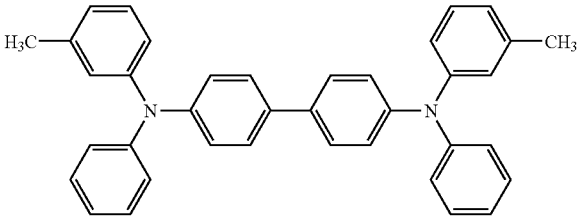

(4-2)

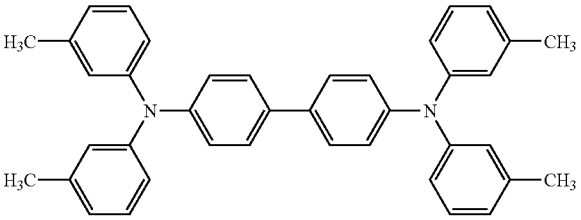

-continued (4-3)

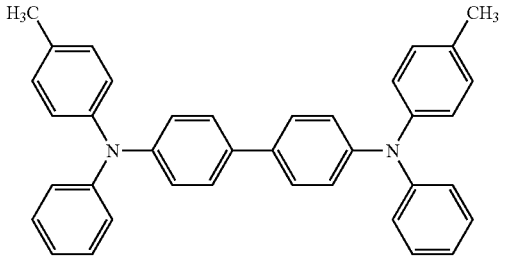

(4-4)

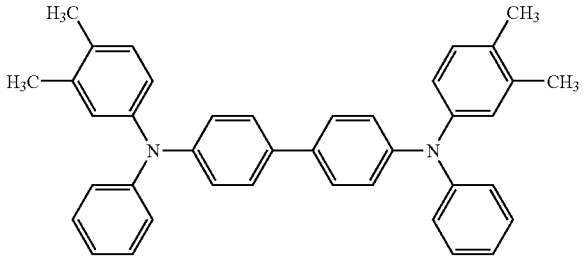

(4-5)

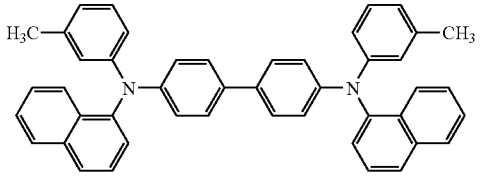

(4-6)

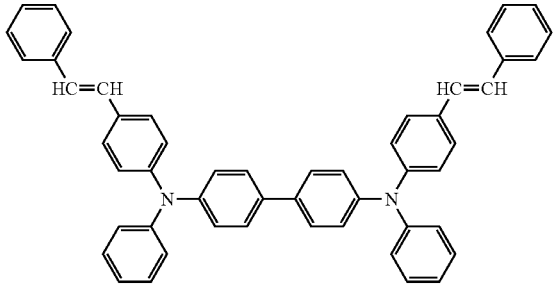

(4-7)

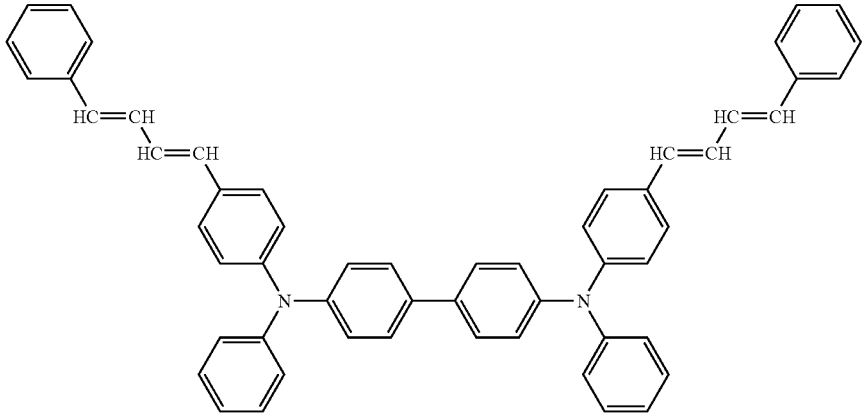

Of these, (4-1) or (4-7) is preferable.

In the charge transport layer serving as the surface layer of the electrophotographic photosensitive member of the present invention, since a matrix is formed of a charge transporting material and at least one of polyester resin C and polycarbonate resin D, and a domain is formed of polyester resin A, contact stress is persistently mitigated and simultaneously electrophotographic characteristics can be obtained satisfactorily.

The compound represented by the above formula (4) advantageously has a high charge transporting ability; however, a problem may reside in compatibility depending upon the composition of the resin forming the charge transport layer. Particularly when a resin having a siloxane moiety is used in order to mitigate contact stress, since compatibility of the siloxane moiety with a charge transporting material is not high, the charge transporting material aggregates, degrading electrophotographic characteristics, in some cases.

In the charge transport layer serving as the surface layer of the electrophotographic photosensitive member of the present invention, since a matrix is formed of a charge transporting material and at least one of polyester resin C and polycarbonate resin D, even if the compound represented by the above formula (4) is used as the charge transporting material, the effect of mitigating stress can be obtained without damaging the electrophotographic characteristics.

Now, the structure of the electrophotographic photosensitive member of the present invention will be described.

As described in the above, the electrophotographic photosensitive member of the present invention is an electrophotographic photosensitive member having a support, a charge generation layer provided on the support and a charge transport layer provided on the charge generation layer and also is an electrophotographic photosensitive member in which the charge transport layer serves as the surface of the electrophotographic photosensitive member layer (the uppermost layer).

Furthermore, the charge transport layer of the electrophotographic photosensitive member of the present invention contains a charge transporting material. Furthermore, the charge transport layer has a polyester resin A and at least one of polyester resin C and polycarbonate resin D.

Furthermore, the charge transport layer may have a laminate structure. In this case, the above matrix-domain structure is contained at least in the uppermost charge transport layer on the side of surface. As the electrophotographic photosensitive member, generally a cylindrical electrophotographic photosensitive member having a photosensitive layer formed on a cylindrical support is widely used; however, a shape such as a belt shape or sheet form can be used.

As the support, a support having a conductivity (conductive support) is preferred, a support formed of a metal such as aluminum, an aluminum alloy and stainless steel can be used.

In the case of a support formed of aluminum and an aluminum ally, use may be made of an ED tube, an EI tube and these tubes cut out or treated with electropolishing (electrolysis performed by an electrode having an electrolysis function and an electrolytic solution and polishing by a grind stone having a polishing function) and wet or dry honing.

Furthermore, a metal support or a resin support having a film layer formed by vapor deposition of aluminum, an aluminum alloy or an indium oxide-tin oxide alloy can be used.

As the resin support, for example, supports formed of polyethylene terephthalate, polybutylene terephthalate, a phenol resin, polypropylene and a polystyrene resin may be mentioned.

Furthermore, supports formed by impregnating a resin or a paper sheet with a conductive particle such as carbon black, a tin oxide particle, a titanium oxide particle and a silver particle and a plastic having a conductive binder resin can be used.

The surface of the support may be applied with a cutting treatment, a surface-roughening treatment or an alumite treatment in order to prevent formation of interference fringe caused by scattering of light such as laser light.

When a layer is provided on the surface of the support in order to impart conductivity, the volume resistivity of the layer is preferably $1\times10^{10}$ Ω·cm or less, and, particularly, more preferably $1\times10^{6}$ Ω·cm or less.

A conductive layer may be provided between the support and intermediate layer (described later) or the charge generation layer in order to prevent interference fringe caused by scattering of light such as laser light or to cover a scratch of the support. This is a layer formed by use of a conductive-layer coating solution having a conductive particle dispersed in a binder resin.

As the conductive particle, for example, carbon black, acetylene black, metal powders such as aluminum, nickel, iron, nichrome, copper, zinc and silver; and metal oxide powders such as conductive tin oxide and ITO may be mentioned.

Furthermore, as the binder resin, for example, polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, poly vinylidene chloride, a polyarylate resin, a phenoxy resin, polycarbonate, a cellulose acetate resin, an ethylcellulose resin, polyvinyl butyral, polyvinyl formal, polyvinyltoluene, poly-N-vinylcarbazole, an acrylic resin, a silicone resin, an epoxy resin, a melamine resin, an urethane resin, a phenol resin and an alkyd resin may be mentioned.

As the solvent for the conductive-layer coating solution, for example, ether solvents such as tetrahydrofuran and ethylene glycol dimethyl ether; alcohol solvents such as methanol; ketone solvent such as methyl ethyl ketone; and aromatic hydrocarbon solvents such as toluene may be mentioned.

The film thickness of the conductive layer is preferably 0.2 μm or more and 40 μm or less and, more preferably 1 μm or more and 35 μm or less, and further more preferably 5 μm or more and 30 μm or less.

A conductive layer having a conductive particle and a particle for controlling resistivity dispersed therein tends to have a rough surface.

Between the support or the conductive layer and the charge generation layer, an intermediate layer having a barrier function and an adhesive function may be provided. The intermediate layer is formed, for example, in order to improve adhesion with a photosensitive layer, improve coating processability, improve a charge injection property from the support, and prevent a photosensitive layer from being electrically damaged.

The intermediate layer can be formed by applying an intermediate-layer coating solution containing a binder resin onto a conductive layer, and drying or hardening it.

As the binder resin of the intermediate layer, for example, a water soluble resin such as polyvinyl alcohol, polyvinyl methyl ether, a polyacrylic acid, methylcellulose, ethylcellulose, polyglutamic acid or casein, a polyamide resin, a polyimide resin, a polyamide imide resin, a polyamic acid resin, a melamine resin, an epoxy resin, a polyurethane resin and a polyglutamate resin may be mentioned.

In order to effectively express the electric barrier property of the intermediate layer, and furthermore, to optimize coating property, adhesive property, solvent resistance and resistance, the binder resin of the intermediate layer is preferably a thermoplastic resin. More specifically, a thermoplastic polyamide resin is preferable. As the polyamide resin, low crystalline or amorphous nylon copolymer, that can be applied in a solution state, is preferable.

The film thickness of the intermediate is preferably 0.05 μm or more and 7 μm or less, and more preferably 0.1 μm or more and 2 μm or less.

Furthermore, to keep smooth charge (carrier) flow in the intermediate layer, the intermediate layer may contain a semiconductive particles or an electron transporting material (electron accepting material such as an acceptor).

On the support, the conductive layer or the intermediate layer, a charge generation layer is provided.

As the charge generating material to be used in the electrophotographic photosensitive member of the present invention, for example, azo pigments such as monoazo, disazo and trisazo; phthalocyanines such as a metallophthalocyanine, a non-metallophthalocyanine; indigo pigments such as indigo and thioindigo; perylene pigments such as perylene acid anhydride and perylene acid imide; polycyclic quinone pigments such as anthraquinone and pyrenequinone; a squarylium coloring matter, a pyrylium salt, a thiapyrylium salt, a triphenyl methane coloring matter, inorganic substances such as selenium, selenium-tellurium and amorphous silicone; a quinacridon pigment, an azulenium salt pigment, a cyanine dye, a xanthene coloring matter, a quinone imine coloring matter and a styryl coloring matter may be mentioned. These charge generating materials may be used alone or as a mixture of two types or more. Of these, particularly, metallophthalocyanines such as oxytitanium phthalocyanine, hydroxygallium phthalocyanine and chlorogallium phthalocyanine are preferable since it is highly sensitive.

As the binder resin for use in the charge generation layer, for example, a polycarbonate resin, a polyester resin, a polyarylate resin, a butyral resin, a polystyrene resin, a polyvinyl acetal resin, a diallylphthalate resin, an acrylic resin, a methacrylic resin, a vinyl acetate resin, a phenol resin, a silicone resin, a polysulfone resin, a styrene-butadiene copolymer resin, an alkyd resin, an epoxy resin, a urea resin and a vinyl chloride-vinyl acetate copolymer resin may be mentioned. Of these, particularly, a butyral resin is preferable. These can be used alone or as a mixture or as a copolymer of two or more types.

The charge generation layer can be formed by applying a charge-generating layer coating solution obtained by dispersing a charge generating material and a binder resin in a solvent and drying it. Furthermore, the charge generation layer may be a deposition film of a charge generating material.

As the dispersion method, for example, methods using a homogenizer, ultrasonic wave, a ball mill, a sand mill, an attritor and a roll mill may be mentioned.

The ratio of the charge generating material to the binder resin preferably fall within the range of 1:10 to 10:1 (mass ratio), and particularly, more preferably within the range of 1:1 to 3:1 (mass ratio).

The solvent to be used in the charge-generating layer coating solution is selected based on the solubility and dispersion stability of the binder resin and the charge generating material to be used. As the organic solvent, for example, an alcohol solvent, a sulfoxide solvent, a ketone solvent, an ether solvent, an ester solvent or an aromatic hydrocarbon solvent may be mentioned.

The film thickness of the charge generation layer is preferably 5 μm or less, and more preferably 0.1 μm or more and 2 μm or less.

Furthermore, to the charge generation layer, various types of sensitizing agents, antioxidants, UV ray absorbers and plasticizers can be optionally added. Furthermore, to keep smooth charge (carrier) flow, the intermediate layer in the charge generation layer, the charge generation layer may contain an electron transporting material (electron accepting material such as an acceptor).

On the charge generation layer, a charge transport layer is provided.

As the charge transporting material to be used in the electrophotographic photosensitive member of the present invention, for example, a triarylamine compound, a hydrazone compound, a styryl compound, a stilbene compound, a pyrazoline compound, an oxazole compound, a thiazole compound and a triallylmethane compound, as described above, may be mentioned. Of these, a compound represented by the above formula (4) is preferable. Furthermore, the content of a compound represented by the above formula (4) in the charge transport layer is preferably not less than 10% by mass relative to the total mass of all charge transporting materials in the charge transport layer.

The charge transport layer serving as the surface layer of the electrophotographic photosensitive member of the present invention contains polyester resin A and at least one of polyester resin C and polycarbonate resin D; however another type of resin may be further blended, as described above. Another resin that may be blended is the same as described above.

The charge transport layer can be formed by applying a charge-transporting layer coating solution obtained by dissolving a charge transporting material and the aforementioned resins in a solvent, and drying it.

The ratio of the charge transporting material to the binder resin preferably falls within the range of 4:10 to 20:10 (mass ratio), and more preferably falls within the range of 5:10 to 12:10 (mass ratio).

As the solvent to be used in the charge-transporting layer coating solution, for example, ketone solvents such as acetone and methyl ethyl ketone; ester solvents such as methyl acetate and ethyl acetate; ether solvents such as tetrahydrofuran, dioxolane, dimethoxymethane and dimethoxyethane; and aromatic hydrocarbon solvents such as toluene, xylene and chlorobenzene, may be mentioned. These solvents may be used alone or as a mixture of two or more types. Of these solvents, an ether solvent and an aromatic hydrocarbon solvent are preferably used in view of resin solubility.

The film thickness of the charge transport layer is preferably 5 μm or more and 50 μm or less, and more preferably 10 μm or more and 35 μm or less.

Furthermore, to the charge transport layer, an antioxidant, a UV ray absorber and a plasticizer, etc. can be optionally added.

To each of the layers of the electrophotographic photosensitive member of the present invention, various types of additives can be added. As the additives, for example, deterioration preventing agents such as an antioxidant, a UV ray absorber and a stabilizer against light, microparticles such as an organic microparticle and an inorganic microparticle may be mentioned. As the deterioration preventing agent, for example, a hindered phenol antioxidant, a hindered amine stabilizer against light, a sulfur atom-containing antioxidant and a phosphorus atom-containing antioxidant may be mentioned. As the organic microparticle, for example, a fluorine atom-containing resin particle, a polystyrene microparticle, a polymer resin particle such as a polyethylene resin particle may be mentioned. As the inorganic microparticle, for example, a metal oxide such as silica and alumina may be mentioned.

When a coating solution is applied to form each layer, as a coating method, a dip coating method, a spray coating method, a spinner coating method, a roller coating method, Mayer-bar coating method and a blade coating method may be used.

FIG. 1 shows a view schematically illustrating a structure of an electrophotographic apparatus equipped with a process cartridge having the electrophotographic photosensitive member of the present invention.

In FIG. 1, a cylindrical electrophotographic photosensitive member 1 is driven and rotated in the direction of an arrow about a shaft 2 at a predetermined circumferential speed.

The surface of the electrophotographic photosensitive member 1 driven and rotated is positively or negatively charged to a predetermined potential uniformly by a charging device (primary charging device: charging roller or the like) 3. Subsequently, it is exposed to light (image exposure light) 4, such as slit exposure light and laser beam scanning exposure light, emitted from a light exposure device (not shown in the drawing). In this way, electrostatic latent images corresponding to desired images are formed sequentially on the surface of the electrophotographic photosensitive member 1.

The electrostatic latent image formed on the surface of the electrophotographic photosensitive member 1 is developed into a toner image by a toner contained in a developer of a developing device 5. Subsequently, the toner image formed and carried on the electrophotographic photosensitive member 1 is sequentially transferred to a transfer material (paper, etc.) P by a transfer bias from a transfer device (transfer roller) 6. Note that, the transfer material P is taken up from a transfer material supply device (not shown) in synchronisms with the ration of the electrophotographic photosensitive member 1 and fed to the contact portion between the electrophotographic photosensitive member 1 and the transfer device 6.

The transfer material P having the toner image transferred thereon is separated from the surface of the electrophotographic photosensitive member 1 and introduced in a fixation device 8, in which the image is fixed. In this way, a material (print, copy) having an image formed thereon is discharged out of the apparatus as a printed matter.

After a toner image is transferred, the surface of the electrophotographic photosensitive member 1 is cleaned by removing the remaining developer (toner) by a cleaning device (cleaning blade) 7. Subsequently, the surface is exposed to pre exposure light (not shown) emitted from the pre-light exposure device (not shown) to remove charge, and thereafter, repeatedly used in image formation. Note that, as shown in FIG. 1, when the charging device 3 is a contact charging device using a charge roller, etc., the pre-exposure light mentioned above is not always necessary.

A plurality of structural elements such as the above electrophotographic photosensitive member 1, the charging device 3, the developing device 5, the transfer device 6 and the charging device 7 are installed in a container and united as one body as a process cartridge. The process cartridge may be detachably provided to an electrophotographic apparatus main body, such as a copying machine and a laser beam printer. In FIG. 1, the electrophotographic photosensitive member 1, the charging device 3, the developing device 5 and the charging device 7 are integrally held in a cartridge and used as a process cartridge 9 detachably provided to the electrophotographic apparatus main body by use of a guide 10 such as a rail of the electrophotographic apparatus main body.

Figure 2:
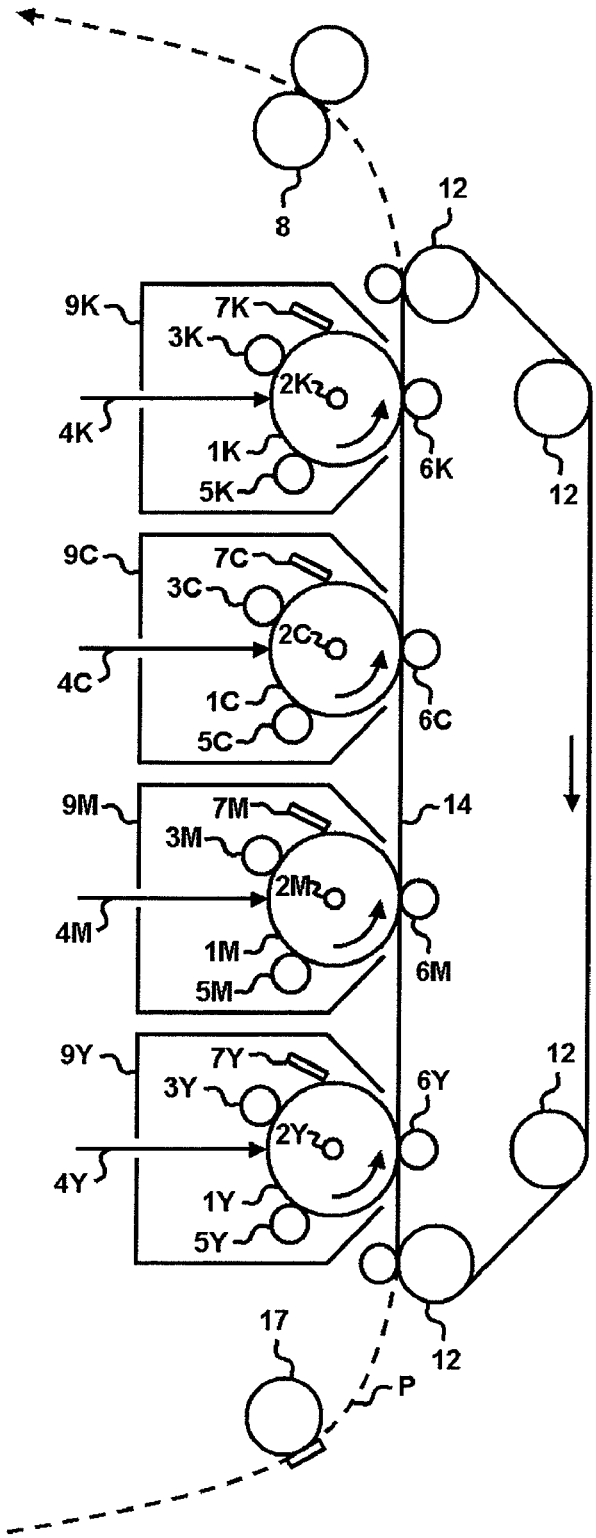
FIG. 2 is a view schematically illustrating a structure of a color electrophotographic apparatus (in-line system) provided with a process cartridge having the electrophotographic photosensitive member of the present invention.

FIG. 2 shows a view schematically illustrating a structure of a color electrophotographic apparatus (in-line system) equipped with process cartridges having the electrophotographic photosensitive member of the present invention.

In FIG. 2, reference symbols 1Y, 1M, 1C and 1K indicate cylindrical electrophotographic photosensitive members (electrophotographic photosensitive members for first to fourth-colors), which are driven and rotated about the axes of 2Y, 2M, 2C and 2K respectively in the direction indicated by an arrow at a predetermined circumference speed.

The surface of the electrophotographic photosensitive member 1Y for the first-color to be driven and rotated is positively or negatively charged to a predetermined potential uniformly by a first-color charging device (primary charging device: charging roller) 3Y. Subsequently, the surface is exposed to exposure light (image exposure light) 4Y emitted from a light exposure device (not shown), such as a slit light exposure and a laser beam scanning light exposure. The exposure light 4Y corresponds to a first-color component image (e.g., a yellow component image) of a desired color image. In this way, on the surface of the first-color electrophotographic photosensitive member 1Y, the first-color component electrostatic latent images (yellow component electrostatic latent image) corresponding to the first-color component images of desired color images are subsequently formed.

A transfer material conveying member (transfer material conveyer belt) 14 stretched by stretching/extending rollers 12 is driven and rotated in the direction indicated by an arrow at almost the same circumference speed as those of the first to fourth-color electrophotographic photosensitive members 1Y, 1M, 1C and 1K (e.g., 97 to 103% of the circumference speeds of the first to fourth-color electrophotographic photosensitive members 1Y, 1M, 1C and 1K). Furthermore, the transfer material (paper sheet, etc.) P fed from a transfer material supply device 17 is electrostatically carried (adsorbed) by a transfer material conveying member 14 and subsequently transferred to the contract portion between the first to fourth-color electrophotographic photosensitive members 1Y, 1M, 1C and 1K and the transfer material conveying member.

The first-color component electrostatic latent image formed on the surface of the first-color electrophotographic photosensitive member 1Y is developed by the toner of the first-color developing device 5Y to form a first-color toner image (yellow toner image). Subsequently, the first-color toner image carried on the surface of the first-color electrophotographic photosensitive member 1Y is sequentially transferred to the transfer material P, which is carried on the transfer material conveying member 14 and passes through the space between the space between the first-color electrophotographic photosensitive member 1Y and the first-color transfer device 6Y, by transfer bias from the first-color transfer device (transfer roller, etc.) 6Y.

After the first-color toner image is transferred, the surface of the first-color electrophotographic photosensitive member 1Y is cleaned by removing the remaining toner by the first-color cleaning device (cleaning blade) 7Y and repeatedly used for formation of the first-color toner image.

The first-color electrophotographic photosensitive member 1Y, the first-color charging device 3Y, the first-color light exposure device for emitting exposure light 4Y corresponding to a first-color component image, the first-color developing device 5Y and the first-color transfer device 6Y are collectively referred to as a first-color image formation section.

A second-color image formation section, which has a second-color electrophotographic photosensitive member 1M, a second-color charging device 3M, a second-color exposure device for emitting exposure light 4M corresponding to a second-color component image, a second-color developing device 5M and a second-color transfer device 6M; a third-color image formation section, which has a third-color electrophotographic photosensitive member 1C, a third-color charging device 3C, a third-color exposure device for emitting exposure light 4C corresponding to a third-color component image, a third-color developing device 5C and a third-color transfer device 6C; and a fourth-color image formation section, which has a fourth-color electrophotographic photosensitive member 1K, a fourth-color charging device 3K, a fourth-color exposure device for emitting exposure light 4K corresponding to a fourth-color component image, a fourth-color developing device 5K and a fourth-color transfer device 6K, are operated in the same manner as in the first-color image formation device. More specifically, to the transfer material P carried by the transfer material conveying member 14 and having the first-color toner image transferred thereon, a second-color toner image (magenta toner image), a third-color toner image (cyan toner image), a fourth-color toner image (black toner image) are sequentially transferred. In this way, on the transfer material P carried by the transfer material conveying member 14, a synthesized toner image corresponding to a desired color image is formed.

The transfer material P having the synthesized toner image formed thereon is separated from the surface of the transfer material conveying member 14 and introduced in the fixation device 8, in which the image is fixed. In this way, a material (print, copy) having a color-image formed thereon is output from the apparatus as a printed matter.

Furthermore, after remaining toner is removed by the first-color to fourth-color charging device 7Y, 7M, 7C and 7K, the charge of the surfaces of the first to fourth-color electrophotographic photosensitive members 1Y, 1M, 1C and 1K may be removed by pre-light exposure from the pre-light exposure device. However, when the first-color to fourth-color charging device 3Y, 3M, 3C and 3K are contact charging device using a charging roller as shown in FIG. 2, pre-light exposure is not always necessary.

Of the structural elements such as the electrophotographic photosensitive member, the charging device, the developing device, the transfer device and the cleaning device, a plurality of structural units are installed in a container and united as a process cartridge. The process cartridge may be detachably provided to an electrophotographic apparatus main body such as a copying machine and a laser beam printer. In FIG. 2, the electrophotographic photosensitive member, the charging device, the developing device and the charging device are integrally united into one body in a cartridge per image formation section and used as a cartridge. Process cartridges 9Y, 9M, 9C and 9K may be detachably provided to the electrophotographic apparatus main body by use of guide (not shown) such as rails of the electrophotographic apparatus main body.

EXAMPLES

The present invention will be described more specifically by way of specific examples. However, the present invention is not limited to these. Note that, the "parts" in the examples refers to "parts by mass".

Example 1

An aluminum cylinder having a diameter of 30 mm and a length of 260.5 mm was used as a support.

Next, 10 parts of $SnO_2$-coated barium sulfate (conductive particles), 2 parts of titanium oxide (pigment for controlling resistance), 6 parts of a phenol resin (binder resin), 0.001 part of silicone oil (leveling agent) and a solvent mixture of methanol (4 parts)/methoxy propanol (16 parts), a conductive-layer coating solution was prepared.

The conductive-layer coating solution was applied on the support by dipping and hardened by thermal setting at 140° C. for 30 minutes to obtain a conductive layer having a film thickness of 15 μm.

Next, N-methoxymethylated nylon (3 parts) and a nylon copolymer (3 parts) were dissolved in a solvent mixture of methanol (65 parts)/n-butanol (30 parts) to prepare an intermediate-layer coating solution.

The intermediate-layer coating solution was applied onto the conductive layer by dipping and dried at 100° C. for 10 minutes to obtain an intermediate layer having a film thickness of 0.7 μm.

Next, 10 parts of crystalline hydroxygallium phthalocyanine (charge generating material), which had intensive peaks at a Bragg angle (in CuKα characteristic X-ray diffraction) 2θ±0.2° of 7.5°, 9.9°, 16.3°, 18.6°, 25.1° and 28.3°, was added to a solution obtained by dissolving 5 parts of polyvinyl butyral resin (trade name: SLEC BX-1, a binder resin manufactured by Sekisui Chemical Co., Ltd.) in cyclohexanone (250 parts). The mixture was dispersed by a sand mill apparatus using glass beads having a diameter of 1 mm under an atmosphere of 23±3° C. for one hour. After dispersion, ethyl acetate (250 parts) was added to prepare a charge-generating layer coating solution.

The charge-generating layer coating solution was applied onto the intermediate layer by dipping and dried at 100° C. for 10 minutes to form a charge generation layer having a film thickness of 0.26 μm.

Next, 1 part of a compound (charge transporting material) represented by the above formula (4-1), 9 parts of the compound (charge transporting material) represented by the following formula (CTM-1):

(CTM-1)

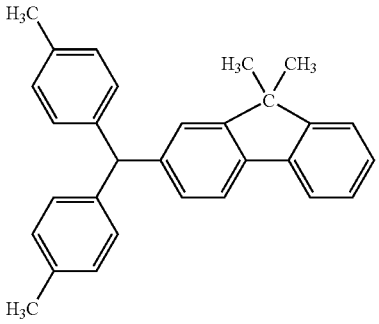

3 parts of polyester resin A (A1) synthesized in Synthesis Example 1 and 7 parts of a polyester resin C (1) (weight average molecular weight 120,000) having the repeating structural unit represented by the above formula (2-12) and the repeating structural unit represented by the above formula (2-24) in a molar ratio of 5:5 were dissolved in a solvent mixture of dimethoxy methane (20 parts) and monochlorobenzene (60 parts) to prepare a charge-transporting layer coating solution.

The charge-transporting layer coating solution was applied onto the charge generation layer by dipping and dried at 120° C. for one hour to form a charge transport layer having a film thickness of 19 μm. It was confirmed that a domain formed of polyester resin A (A1) is present in the matrix formed of a charge transporting material and polyester resin C (1) in the charge transport layer formed.

In this way, an electrophotographic photosensitive member having the charge transport layer as a surface layer was manufactured.

Evaluation was made in the same manner as in Example 1. The results are shown in Table 4.

Next, evaluation will be described.

Evaluation was made with respect to variation (potential change) of a light-part potential in the case of repeated use of 2,000 paper sheets, a relative value of initial torque and a relative value of torque in the case of repeated use of 2,000 paper sheets, and observation on the surface of the electrophotographic photosensitive member when torque was measured.

As an evaluation apparatus, a laser beam printer LBP-2510 (charge (primary charge): contact charge system, process speed: 94.2 mm/s) manufactured by Canon Inc. was modified such that the charge potential (dark-portion potential) of an electrophotographic photosensitive member could be adjusted and put in use. Furthermore, the contact angle of a cleaning blade made of polyurethane rubber with respect to the surface of the electrophotographic photosensitive member was set to 25° and the contact pressure thereof was set at 35 g/cm.

Evaluation was made under an environment of a temperature of 23° C. and a relative humidity of 50%.

<Evaluation of Potential Change>

The exposure amount (exposure amount of image) of a laser light source (780 nm) of the evaluation apparatus was set such that the light amount at the surface of the electrophotographic photosensitive member was 0.3 $\mu J/cm^2$.

The surface potential of the electrophotographic photosensitive member (dark-part potential and light-part potential) was measured at the position of a developing device by exchanging the developing device by a jig, which was fixed such that a potential measuring probe is positioned at a distance of 130 mm from the edge of an electrophotographic photosensitive member.

The potential of the dark-part, i.e., unexposed part, of an electrophotographic photosensitive member was set at −450 V, and then laser light was applied. The potential of a light part, which was light-attenuated from the dark-part potential, was measured.

Furthermore, using A4-size regular paper sheets, an image was output continuously on 2,000 sheets. Before and after the operation, variation of light-part potential was evaluated. The results are shown in the column of potential variation in Table 4. Note that, the test chart used herein had a printing ratio of 5%.

<Evaluation of Relative Torque Value>

Under the same conditions as in the above potential change evaluation conditions, the driving current value (current value A) of a rotation motor for an electrophotographic photosensitive member was measured. In this evaluation, the amount of contact stress between an electrophotographic photosensitive member and a cleaning blade is evaluated. The magnitude of the current value obtained indicates the amount of contact stress between an electrophotographic photosensitive member and a cleaning blade.

Furthermore, an electrophotographic photosensitive member, which was to be used as a control to obtain a relative torque value, was manufactured according to the following methods.

An electrophotographic photosensitive member was manufactured in the same manner as in Example 1 except that polyester resin A (A1) of the charge transport layer of the electrophotographic photosensitive member of Example 1 was changed to a polyester resin (weight average molecular weight 120,000) having the repeating structural unit represented by the above formula (2-12) and the repeating structural unit represented by the above formula (2-24) in a molar ratio of 5:5. This was used as a control electrophotographic photosensitive member.

Using the control electrophotographic photosensitive member thus manufactured, the driving current value (current value B) of a rotation motor of an electrophotographic photosensitive member was measured in the same manner as in Example 1.

The ratio between the driving current value (current value A) of the electrophotographic photosensitive member using a polyester resin A according to the present invention thus obtained and the driving current value (current value B) of the rotation motor of the electrophotographic photosensitive member using no polyester resin A according to the present invention was calculated. The resultant numerical value of (current value A)/(current value B) was regarded as a relative torque value for comparison. The numerical value of the relative torque value indicates an increase/decrease of the contact stress amount between an electrophotographic photosensitive member and a cleaning blade. The smaller the numerical value of the relative torque value, the lower the contact stress amount between an electrophotographic photosensitive member and a cleaning blade. The results are shown in the column of relative value of initial torque in Table 4.

Subsequently, using A4-size plain paper sheets, an image was output continuously on 2,000 sheets. Note that, the test chart used herein had a printing ratio of 5%.

Thereafter, the relative torque value after repeated use (2,000 sheets) was determined. The relative torque value after repeated use (2,000 sheets) was evaluated in the same manner as in the relative value of initial torque. In this case, the control electrophotographic photosensitive member was repeatedly used for 2000 sheets. Using the driving current value at this time, the relative value of torque after repeated use of 2,000 sheets was calculated. The results are shown in the column of relative torque value after 2,000 sheets in Table 4.

<Evaluation of Matrix-Domain Structure>

In the electrophotographic photosensitive member manufactured by the aforementioned method, the charge transport layer is sectioned perpendicularly. The section of the charge transport layer was observed by use of an ultra-depth profile measuring microscope VK-9500 (manufactured by Keyence Corporation). At this time, the magnification of an objective lens was set at 50 times and a region of 100 μm squares (10,000 $\mu m^2$) in the surface of the electrophotographic photosensitive member was used as a field of vision. The maximum diameters of 100 domain portions randomly selected from those formed in the field of vision were measured. The maximum diameters thus obtained were averaged and used as a number average particle size. The results are shown in Table 4.

Example 2

Electrophotographic photosensitive members were manufactured and evaluated in the same manner as in Example 1 except that the resin of the charge transport layer of Example 1 was changed to those shown in Table 2. It was confirmed that a domain formed of polyester resin A (A1) is present in the matrix formed of a charge transporting material and polyester resin C (1) in the charge transport layer formed. The results are shown in Table 4.

Example 3

An electrophotographic photosensitive member was manufactured and evaluated in the same manner as in Example except that polyester resin C (1) of Example 1 was changed to polycarbonate resin D (1) (weight average molecular weight: 100,000) having a repeating structural unit represented by the above formula (9-4), and the mixing ratio was changed as shown in Table 2. It was confirmed that a domain formed of polyester resin A (A1) is present in the matrix formed of a charge transporting material and polycarbonate resin D (1) in the charge transport layer formed. The results are shown in Table 4.

Examples 5 to 11

Electrophotographic photosensitive members were manufactured and evaluated in the same manner as in Example 1 except that the resin of the charge transport layer of Example 1 was changed to those shown in Table 2. In all cases, it was confirmed that a domain formed of polyester resin A (A2 to A7) is present in the matrix formed of a charge transporting material and polyester resin C (1) or polycarbonate resin D (1), in the charge transport layer formed. The results are shown in Table 4.

Example 12

The same procedure as in Example 1 was performed until the charge generation layer was formed.

Next, 1 part of a compound (charge transporting material) represented by the above formula (4-1), 9 parts of the compound (charge transporting material) represented by the above formula (CTM-1), 2 parts of polyester resin A (B1) synthesized in Synthesis Example 8 and 8 parts of a polyester resin C (1) (weight average molecular weight 120,000) used in Example 1 were dissolved in a solvent mixture of dimethoxy methane (20 parts) and orthoxylene (60 parts) to prepare the charge-transporting layer coating solution.

The charge-transporting layer coating solution was applied onto the charge generation layer by dipping and dried at 120° C. for one hour to form a charge transport layer having a film thickness of 19 μm. It was confirmed that a domain formed of polyester resin A (B1) is present in the matrix formed of a charge transporting material and polyester resin C (1) in the charge transport layer formed.

In this way, an electrophotographic photosensitive member having a charge transport layer as a surface layer was manufactured.

Evaluation was made in the same manner as in Example 1. The results are shown in Table 4.

Examples 13 to 28

Electrophotographic photosensitive members were manufactured and evaluated in the same manner as in Example 12 except that the resin of the charge transport layer of Example 14 was changed to those shown in Table 2. In all cases, it was confirmed that a domain formed of polyester resin A (B1 to B4, C, D, E, F1 to F3) is present in the matrix formed of a charge transporting material and polyester resin C (1) or polycarbonate resin D (1) in the charge transport layer formed. The results are shown in Table 4.

Examples 29 to 31

The same procedure as in Example 1 was performed until the charge generation layer was formed.

Next, 6 parts of a compound (charge transporting material) represented by the above formula (4-7), 3 parts of polyester resin A (G) synthesized in Synthesis Example 18 and 7 parts of a polyester resin C (2) (weight average molecular weight 130,000) having the repeating structural unit represented by the above formula (2-33) were dissolved in a solvent mixture of dimethoxy methane (20 parts) and monochlorobenzene (60 parts) to prepare the charge-transporting layer coating solution.

The charge-transporting layer coating solution was applied onto the charge generation layer by dipping and dried at 120° C. for one hour to form a charge transport layer having a film thickness of 19 μm. It was confirmed that a domain formed of polyester resin A (G) is present in the matrix formed of a charge transporting material and polyester resin C (2) in the charge transport layer formed.

In this way, an electrophotographic photosensitive member having a charge transport layer as a surface layer was manufactured.

Evaluation was made in the same manner as in Example 1. The results are shown in Table 4.

However, the electrophotographic photosensitive member used in torque evaluation was manufactured by changing the resin of the charge transport layer of a control electrophotographic photosensitive member used in Example 1 to a polyester resin C (2) and further the charge transporting material was changed to the compound represented by the above formula (4-7) and subjected to measurement. The results are shown in Table 4.

Examples 32 and 33

An electrophotographic photosensitive member was manufactured and evaluated in the same manner as in Example 32 except that polyester resin C (2) of Example 31 was changed to polycarbonate resin D (2) (weight average molecular weight: 100,000) having a repeating structural unit represented by the above formula (9-1) and the mixing ratio was changed as shown in Table 2. It was confirmed that a domain formed of polyester resin A (G) is present in the matrix formed of a charge transporting material and polycarbonate resin D (2) in the charge transport layer formed. The results are shown in Table 4.

Examples 34 to 36

Electrophotographic photosensitive members were manufactured and evaluated in the same manner as in Example 33 except that the resin of the charge transport layer in Example 29 was changed to those shown in Table 2, and used in mixing ratios shown in Table 2. It was confirmed that a domain formed of polyester resin A (H, I, J, K) is present in the matrix formed of a charge transporting material and polyester resin C (2) in the charge transport layer formed. The results are shown in Table 4.

Examples 37 to 48

Electrophotographic photosensitive members were manufactured and evaluated in the same manner as in Example 1 except that the resin of the charge transport layer in Example 1 was changed to those shown in Table 2. It was confirmed that a domain formed of polyester resin A (L, M, N, O, P, Q, R, S, T3) is present in the matrix formed of a charge transporting material and polyester resin C (1) in the charge transport layer formed. The results are shown in Table 4.

Comparative Example 1

Polyester resin (A8) (weight average molecular weight 120,000) having a content of a siloxane moiety (in the total mass of the polyester resin) of 1% by mass was prepared using, as a dicarboxylic acid halide, dicarboxylic acid halide represented by the above formula (6-1) and dicarboxylic acid halide represented by the above formula (6-2) used in Synthesis Example 1 and using, as the diol, the diol compound represented by the above formula (7-1) and the diol compound represented by formula (8-1) while controlling the use amounts in synthesis.

The same procedure as in Example 1 was performed until the charge generation layer was formed.

An electrophotographic photosensitive member was manufactured and evaluated in the same manner as in Example 1, except that polyester resin (A8) of Example 1 alone was used as a resin. In the charge transport layer formed, a matrix-domain structure was not observed. This is shown in Table 3. The results are shown in Table 5.

Comparative Example 2

The same procedure as in Example 1 was performed until a charge generation layer was formed.

An electrophotographic photosensitive member was manufactured and evaluated in the same manner as in Example 1 except that polyester resin A (A7) of Example 1 alone was used as the resin. A matrix-domain structure was not observed in the charge transport layer formed; however aggregates of the charge transporting material were observed. This is shown in Table 3. The results are shown in Table 5.

Comparative Example 3

Polyester resin (T1) (weight average molecular weight 120,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-8):

(7-8)

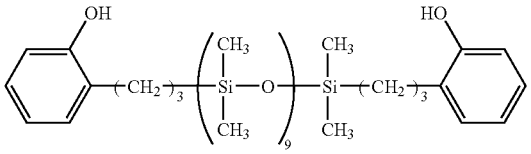

and the diol compound represented by the above formula (8-1), while controlling the use amounts in synthesis. Polyester resin (T1) is a polyester resin containing a repeating structural unit represented by the following formula (P-1):

(P-1)

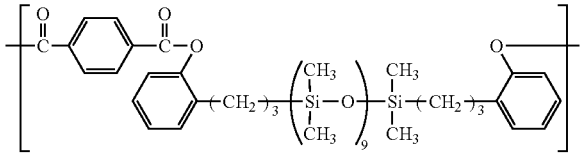

and a repeating structural unit represented by the following formula (P-2):

(P-2)

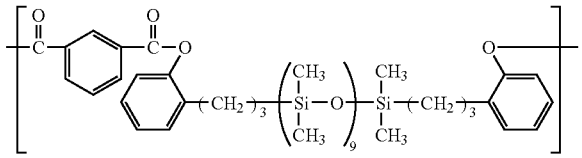

in a molar ratio or 5:5; and the repeating structural unit represented by the above formula (2-12) and the repeating structural unit represented by the above formula (2-24) in a molar ratio of 5:5.

An electrophotographic photosensitive member was manufactured in the same manner as in Example 1 except that polyester resin (T1) of Example 1 alone was used as the resin of the charge transport layer. In the charge transport layer formed, a matrix-domain structure was not observed. Evaluation was made in the same manner as in Example 1. The results are shown in Table 5.

Comparative Example 4

An electrophotographic photosensitive member was manufactured in the same manner as in Example 1, except that polyester resin A (A1) having a siloxane moiety of Example 1 was changed to the polyester resin (T1). In the charge transport layer formed, a matrix-domain structure was not observed. Evaluation was made in the same manner as in Example 1. The results are shown in Table 5.

Comparative Example 5

Polyester resin (U) (weight average molecular weight 120,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-10):

(7-10)

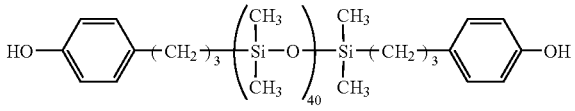

the diol compound represented by the above formula (8-1), while controlling the use amounts in synthesis. Polyester resin (U) is a polyester resin containing a repeating structural unit represented by the following formula (P-5):

(P-5)

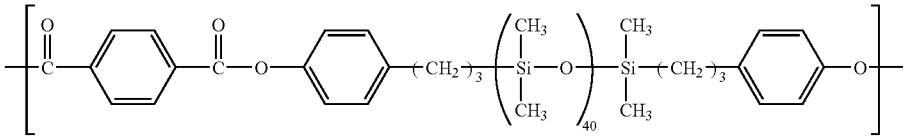

and a repeating structural unit represented by the following formula (P-6):

(P-6)

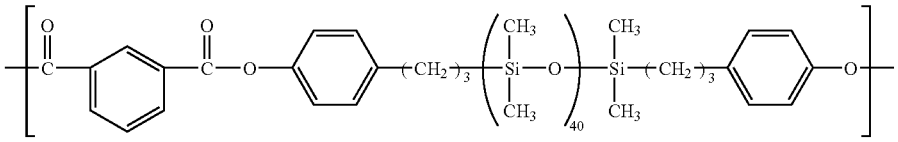

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that polyester resin (U) of Example 1 alone was used as the resin of the charge transport layer. This is shown in Table 3. A matrix-domain structure was not observed in the charge transport layer formed; however aggregates of the charge transporting material were observed. Evaluation was made in the same manner as in Example 1. The results are shown in Table 5.

Comparative Example 6

An electrophotographic photosensitive member was manufactured and evaluated in the same manner as in Example except that polyester resin A (A1) having a siloxane moiety in Example 1 was changed to the polyester resin (U). A matrix-domain structure was observed in the charge transport layer formed and a few aggregates of the charge transporting material were observed within a domain. This is shown in Table 3. Evaluation was made in the same manner as in Example 1. The results are shown in Table 5.

Comparative Example 7

Polyester resin (V) (weight average molecular weight 120,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-11):

(7-11)

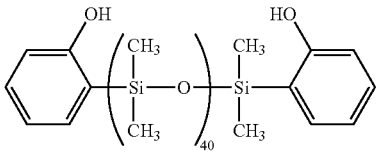

and the repeating structural unit represented by the above formula (8-1), while controlling the use amounts in synthesis. Polyester resin (V) is a polyester resin containing a repeating structural unit represented by the following formula (P-7):

(P-7)

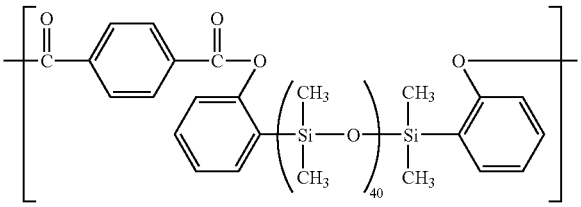

and a repeating structural unit represented by the following formula (P-8):

(P-8)

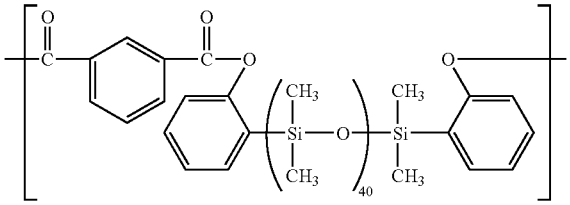

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that polyester resin A (A1) having a siloxane moiety in Example 1 was changed to the polyester resin (V). A matrix-domain structure was observed in the charge transporting layer formed and aggregates of the charge transporting material were observed within a domain. This is shown in Table 3. Evaluation was made in the same manner as in Example 1. The results are shown in Table 5.

Comparative Example 8

Polyester resin (W1) (weight average molecular weight 100,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented the following formula (7-10):

(7-12)

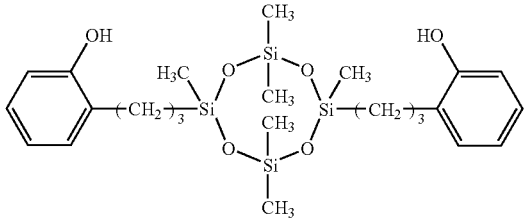

and the diol compound represented by the above formula (8-1), while controlling the use amounts in synthesis. Polyester resin (W1) is a polyester resin containing a repeating structural unit represented the following formula (P-9):

(P-9)

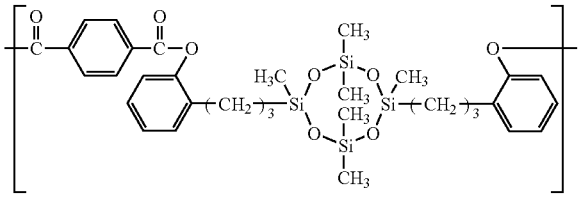

and a repeating structural unit represented the following formula (P-10):

(P-10)

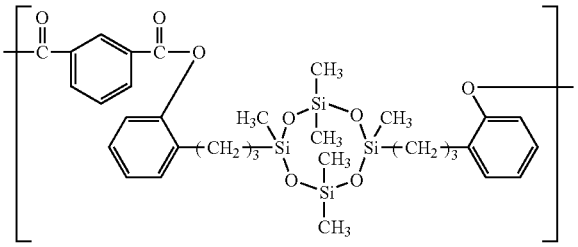

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that polyester resin A (A1) having a siloxane moiety in Example 1 was changed to the polyester resin (W1). This is shown in Table 3. In the charge transport layer formed, a matrix-domain structure was not observed. Evaluation was made in the same manner as in Example 1. The results are shown in Table 5.

Comparative Example 9

Polyester resin (W2) (weight average molecular weight 80,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-13):

(7-13)

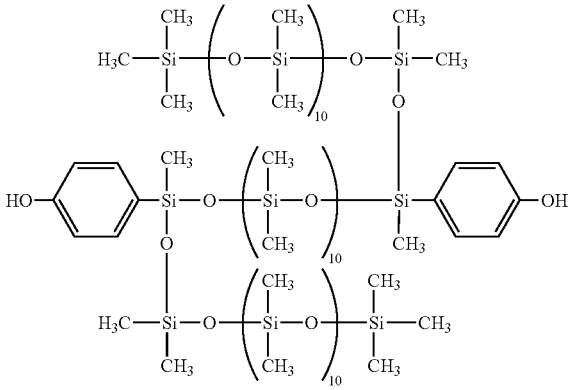

and the diol compound represented by and the above formula (8-1), while controlling the use amounts in synthesis. Polyester resin (W2) is a polyester resin containing a repeating structural unit represented by the following formula (P-11):

(P-11)

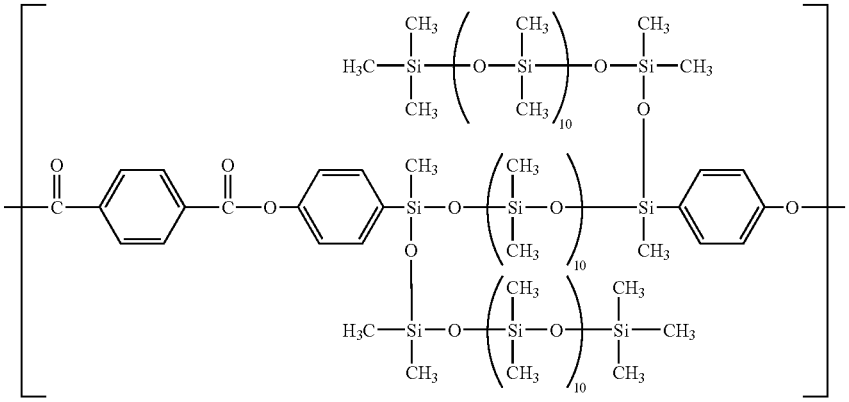

and a repeating structural unit represented the following formula (P-12):

(P-12)

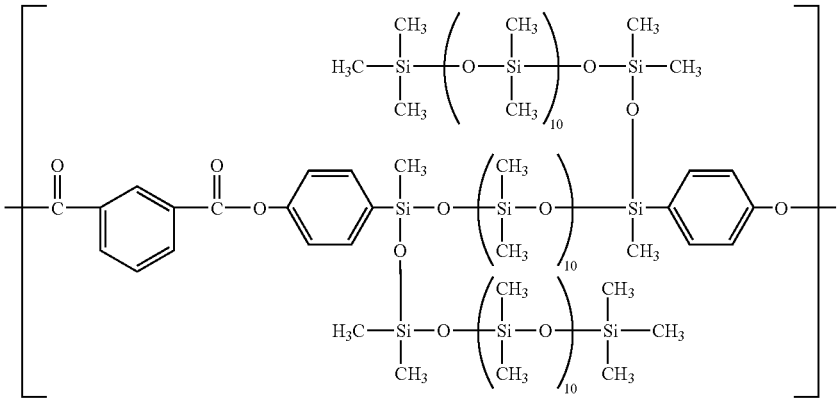

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that polyester resin A (A1) having a siloxane moiety in Example 1 was changed to the polyester resin (W2). This is shown in Table 3. A matrix-domain structure was observed in the charge transport layer formed and aggregates of the charge transporting material were observed within a domain. This is shown in Table 3. Evaluation was made in the same manner as in Example 1. The results are shown in Table 5.

Comparative Example 10

An electrophotographic photosensitive member was manufactured in the same manner as in Example 1 except that the polyester resin A (A1) having a siloxane moiety in Example 1 was changed to polyester resin (X) described in Japanese Patent Application Laid-Open No. 2003-302780 (which is a polyester resin having a repeating structural unit represented by the following formula (P-13):

(P-13)

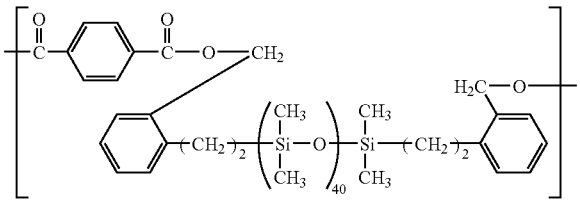

and the repeating structural unit represented by the above formula (2-15) in a molar ratio of 15:85). This is shown in Table 3. A matrix-domain structure was observed in the charge transport layer formed and aggregates of the charge transporting material were observed within a domain. Evaluation was made in the same manner as in Example 1. The results are shown in Table 5.

Comparative Example 11

In place of polyester resin A (A1) having a siloxane moiety, polyester resin (Y) was synthesized having a repeating structural unit represented by the following the formula (P-14):

(P-14)

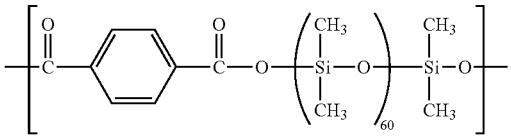

and a repeating structural unit represented by the following formula (P-15):

(P-15)

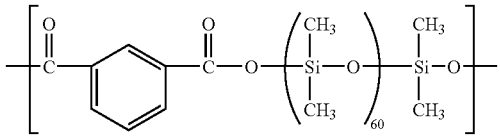

in a molar ratio of 5:5, and having the repeating structural unit represented by the above formula (2-11) and the repeating structural unit represented by the above formula (2-23) in a molar ratio of 5:5. The content of the siloxane moiety of the resin synthesized was 30% by mass.

An electrophotographic photosensitive member was manufactured in the same manner as in Example 1 except that polyester resin (Y) was used in place of polyester resin A (A1) having a siloxane moiety of Example 1. This is shown in Table 3. A matrix-domain structure was observed in the charge transport layer formed and aggregates of the charge transporting material were observed within a domain. This is shown in Table 3. Evaluation was made in the same manner as in Example 1. The results are shown in Table 5.

Comparative Example 12

Polyester resin (Z) was synthesized having the repeating structural unit represented by the above formula (2-12) and the repeating structural unit represented by the above formula (2-24) and having a structure represented by the following formula (7-14):

(7-14)

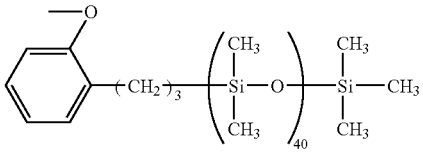

introduced to an end. The content of a siloxane moiety in the synthesized resin was 1.2% by mass.

An electrophotographic photosensitive member was manufactured in the same manner as in Example 1 except that the polyester resin A (A1) having a siloxane moiety in Example 1 was changed to the polyester resin (Z). This is shown in Table 3. In the charge transport layer formed, a matrix-domain structure was not observed. Evaluation was made in the same manner as in Example 1. The results are shown in Table 5.

Comparative Example 13

An electrophotographic photosensitive member was manufactured in the same manner as in Example 1 except that polycarbonate resin (A), having the repeating structural unit represented by the above formula (9-4) and a repeating structural unit represented by the following formula (P-16):

(P-16)

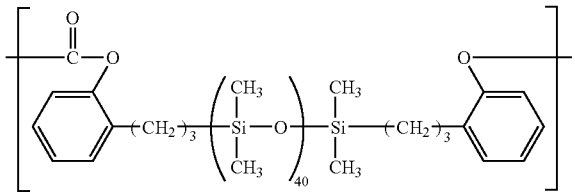

in a molar ratio of 5:5 was synthesized and mixed with a polyester resin C (1) having the repeating structural unit represented by the above formula (2-12) and the repeating structural unit represented by the above formula (2-24) in a molar ratio of 5:5, as shown in Table 3. This is shown in Table 3. In the charge transport layer formed, a matrix-domain structure was not observed. Evaluation was made in the same manner as in Example 1. The results are shown in Table 5.

Comparative Example 14

Polycarbonate resin (B), which is formed by introducing a structure represented by the above formula (7-14) into an end of a resin having a structural unit represented by the above formula (9-4), was synthesized. The content of a siloxane moiety in the resin synthesized was 25% by mass.

An electrophotographic photosensitive member was manufactured in the same manner as in Example 1 except that polycarbonate resin (B) of Example 1 alone was used as the resin of the charge transport layer. This is shown in Table 3. A small matrix-domain structure was observed in the charge transport layer formed, and further aggregates of a charge transporting material were observed outside a domain. Evaluation was made in the same manner as in Example 1. The results are shown in Table 5.

Comparative Example 15

The same procedure as in Example 1 was performed until the charge generation layer was formed.

Next, a charge-transporting layer coating solution was prepared by dissolving 1 part of a compound (charge transporting material) represented by the above formula (4-1), 9 parts of a compound (charge transporting material) represented by the above formula (CTM-1), 9.9 parts of polyester resin C (1) and 0.1 parts of methylphenylpolysiloxane in a solvent mixture of dimethoxy methane (20 parts) and monochlorobenzene (60 parts).

The charge-transporting layer coating solution was applied onto the charge generation layer by dipping and dried at 120° C. for one hour to form a charge transport layer having a film thickness of 19 μm. It was confirmed that a domain formed of methylphenylpolysiloxane is present in the matrix formed of a charge transporting material and polyester resin C (1) in the charge transport layer formed.

In this way, an electrophotographic photosensitive member having the charge transport layer as a surface layer was manufactured.

Evaluation was made in the same manner as in Example 1. The results are shown in Table 5.

TABLE 2

| | Resin A (Polyester resin A) | Mass ratio A of siloxane (% by mass) | Resin B (resin having a different structure) | Mixing ratio of resin A to resin B | Mass ratio B of siloxane (% by mass) |
|---|---|---|---|---|---|
| Example 1 | Polyester resin A(A1) | 20 | Polyester resin C(1) | A/B = 3/7 | 6 |
| Example 2 | Polyester resin A(A1) | 20 | Polyester resin C(1) | A/B = 2/8 | 4 |
| Example 3 | Polyester resin A(A1) | 20 | Polycarbonate resin D(1) | A/B = 3/7 | 6 |
| Example 4 | Polyester resin A(A2) | 20 | Polyester resin C(1) | A/B = 3/7 | 6 |
| Example 5 | Polyester resin A(A3) | 20 | Polyester resin C(1) | A/B = 3/7 | 6 |
| Example 6 | Polyester resin A(A4) | 20 | Polyester resin C(1) | A/B = 3/7 | 6 |
| Example 7 | Polyester resin A(A5) | 25 | Polyester resin C(1) | A/B = 2/8 | 5 |
| Example 8 | Polyester resin A(A6) | 30 | Polyester resin C(1) | A/B = 2/8 | 6 |
| Example 9 | Polyester resin A(A6) | 30 | Polyester resin C(1) | A/B = 1/9 | 3 |
| Example 10 | Polyester resin A(A7) | 40 | Polyester resin C(1) | A/B = 3/7 | 12 |
| Example 11 | Polyester resin A(A7) | 40 | Polycarbonate resin D(1) | A/B = 3/7 | 12 |
| Example 12 | Polyester resin A(B1) | 20 | Polyester resin C(1) | A/B = 3/7 | 6 |
| Example 13 | Polyester resin A(B1) | 20 | Polyester resin C(1) | A/B = 2/8 | 4 |
| Example 14 | Polyester resin A(B1) | 20 | Polyester resin C(1) | A/B = 1/9 | 2 |
| Example 15 | Polyester resin A(B1) | 20 | Polycarbonate resin D(1) | A/B = 3/7 | 6 |
| Example 16 | Polyester resin A(B2) | 30 | Polyester resin C(1) | A/B = 3/7 | 9 |
| Example 17 | Polyester resin A(B2) | 30 | Polyester resin C(1) | A/B = 2/8 | 6 |
| Example 18 | Polyester resin A(B2) | 30 | Polyester resin C(1) | A/B = 1/9 | 3 |
| Example 19 | Polyester resin A(B3) | 10 | Polyester resin C(1) | A/B = 3/7 | 3 |
| Example 20 | Polyester resin A(B4) | 5 | Polyester resin C(1) | A/B = 2/8 | 1 |
| Example 21 | Polyester resin A(C) | 20 | Polyester resin C(1) | A/B = 2/8 | 4 |
| Example 22 | Polyester resin A(D) | 20 | Polyester resin C(1) | A/B = 2/8 | 4 |
| Example 23 | Polyester resin A(E) | 20 | Polyester resin C(1) | A/B = 2/8 | 4 |
| Example 24 | Polyester resin A(F1) | 20 | Polyester resin C(1) | A/B = 2/8 | 4 |
| Example 25 | Polyester resin A(F1) | 20 | Polyester resin C(1) | A/B = 1/9 | 2 |
| Example 26 | Polyester resin A(F2) | 10 | Polyester resin C(1) | A/B = 2/8 | 2 |
| Example 27 | Polyester resin A(F2) | 10 | Polyester resin C(1) | A/B = 1/9 | 1 |
| Example 28 | Polyester resin A(F3) | 5 | Polyester resin C(1) | A/B = 2/8 | 1 |
| Example 29 | Polyester resin A(G) | 20 | Polyester resin C(2) | A/B = 3/7 | 6 |
| Example 30 | Polyester resin A(G) | 20 | Polyester resin C(2) | A/B = 2/8 | 4 |
| Example 31 | Polyester resin A(G) | 20 | Polyester resin C(2) | A/B = 1/9 | 2 |
| Example 32 | Polyester resin A(G) | 20 | Polycarbonate resin D(2) | A/B = 3/7 | 6 |
| Example 33 | Polyester resin A(G) | 20 | Polycarbonate resin D(2) | A/B = 2/8 | 4 |
| Example 34 | Polyester resin A(H) | 20 | Polyester resin C(2) | A/B = 3/7 | 6 |
| Example 35 | Polyester resin A(I) | 20 | Polyester resin C(2) | A/B = 3/7 | 6 |
| Example 36 | Polyester resin A(J) | 20 | Polyester resin C(2) | A/B = 3/7 | 6 |
| Example 37 | Polyester resin A(K) | 20 | Polyester resin C(1) | A/B = 3/7 | 6 |
| Example 38 | Polyester resin A(L) | 20 | Polyester resin C(1) | A/B = 3/7 | 6 |
| Example 39 | Polyester resin A(M) | 20 | Polyester resin C(1) | A/B = 3/7 | 6 |
| Example 40 | Polyester resin A(N) | 20 | Polyester resin C(1) | A/B = 3/7 | 6 |
| Example 41 | Polyester resin A(O) | 20 | Polyester resin C(1) | A/B = 3/7 | 6 |
| Example 42 | Polyester resin A(P) | 20 | Polyester resin C(1) | A/B = 3/7 | 6 |
| Example 43 | Polyester resin A(Q) | 20 | Polyester resin C(1) | A/B = 3/7 | 6 |

TABLE 2-continued

| | Resin A (Polyester resin A) | Mass ratio A of siloxane (% by mass) | Resin B (resin having a different structure) | Mixing ratio of resin A to resin B | Mass ratio B of siloxane (% by mass) |
|---|---|---|---|---|---|
| Example 44 | Polyester resin A(R) | 20 | Polyester resin C(1) | A/B = 3/7 | 6 |
| Example 45 | Polyester resin A(S) | 10 | Polyester resin C(1) | A/B = 2/8 | 2 |
| Example 46 | Polyester resin A(S) | 10 | Polyester resin C(1) | A/B = 1/9 | 1 |
| Example 47 | Polyester resin A(T3) | 10 | Polyester resin C(1) | A/B = 2/8 | 2 |
| Example 48 | Polyester resin A(T3) | 10 | Polyester resin C(1) | A/B = 1/9 | 1 |

In Table 2, "Resin A (polyester resin A)" refers to a polyester resin A having a repeating structural unit represented by the above formula (1) and a repeating structural unit represented by the above formula (2).
In Table 2, "Mass ratio A of siloxane (% by mass)" refers to the content (% by mass) of the siloxane moiety in "resin A (polyester resin A)".
In Table 2, "Resin B (resin having a different structure)" refers to at least one of polyester resin C and polycarbonate resin D.
In Table 2, "Mass ratio B of siloxane (% by mass)" refers to the content (% by mass) of the siloxane moiety in "resin A (polyester resin A)" relative to the total mass of the whole resin contained in the charge transport layer.

TABLE 3

| | Resin A | Mass ratio A of siloxane (% by mass) | Resin B (resin having a different structure) | Mixing ratio of resin A to resin B | Mass ratio B of siloxane (% by mass) |
|---|---|---|---|---|---|
| Comparative Example 1 | Polyester resin (A8) | 1 | — | — | 1 |
| Comparative Example 2 | Polyester resin A(A7) | 40 | — | — | 40 |
| Comparative Example 3 | Polyester resin (T1) | 20 | — | — | 20 |
| Comparative Example 4 | Polyester resin (T1) | 20 | Polyester resin C(1) | A/B = 3/7 | 6 |
| Comparative Example 5 | Polyester resin (U) | 20 | — | — | 20 |
| Comparative Example 6 | Polyester resin (U) | 20 | Polyester resin C(1) | A/B = 3/7 | 6 |
| Comparative Example 7 | Polyester resin (V) | 20 | Polyester resin C(1) | A/B = 3/7 | 6 |
| Comparative Example 8 | Polyester resin (W1) | 20 | Polyester resin C(1) | A/B = 3/7 | 6 |
| Comparative Example 9 | Polyester resin (W2) | 20 | Polyester resin C(1) | A/B = 3/7 | 6 |
| Comparative Example 10 | Polyester resin (X) | 50 | Polyester resin C(1) | A/B = 3/7 | 15 |
| Comparative Example 11 | Polyester resin (Y) | 30 | Polyester resin C(1) | A/B = 3/7 | 9 |
| Comparative Example 12 | Polyester resin (Z) | 1.2 | Polyester resin C(1) | A/B = 3/7 | 0.4 |
| Comparative Example 13 | Polycarbonate resin (A) | 84 | Polyester resin C(1) | A/B = 1/9 | 8 |
| Comparative Example 14 | Polycarbonate resin (B) | 25 | — | — | 25 |
| Comparative Example 15 | Phenyl methyl polysiloxane | 100 | Polyester resin C(1) | A/B = 1/99 | 1 |

In Table 3, "Resin A" refers to the content of a resin having a siloxane moiety.
In Table 3, "Mass ratio A of siloxane (% by mass)" refers to the content (% by mass) of the siloxane moiety in "resin A".
The "resin B (resin having a different structure)" in Table 3 refers to a resin having a structure containing no siloxane moiety.
In Table 3, "Mass ratio B of siloxane (% by mass)" refers to the content (% by mass) of siloxane moiety in "resin A" relative to the total mass of the whole resin contained in the charge transport layer.

TABLE 4

| | Potential change (V) | Relative value of initial torque | Relative value of torque after 2,000 sheets | Number average particle size (nm) |
|---|---|---|---|---|
| Example 1 | 5 | 0.79 | 0.89 | 180 |
| Example 2 | 5 | 0.82 | 0.90 | 120 |
| Example 3 | 5 | 0.75 | 0.85 | 150 |
| Example 4 | 5 | 0.80 | 0.83 | 200 |
| Example 5 | 8 | 0.82 | 0.85 | 180 |
| Example 6 | 10 | 0.85 | 0.88 | 200 |
| Example 7 | 8 | 0.70 | 0.75 | 240 |
| Example 8 | 10 | 0.68 | 0.72 | 260 |
| Example 9 | 5 | 0.70 | 0.80 | 130 |

TABLE 4-continued

| | Potential change (V) | Relative value of initial torque | Relative value of torque after 2,000 sheets | Number average particle size (nm) |
|---|---|---|---|---|
| Example 10 | 40 | 0.55 | 0.90 | 600 |
| Example 11 | 35 | 0.60 | 0.85 | 500 |
| Example 12 | 5 | 0.77 | 0.90 | 200 |
| Example 13 | 5 | 0.80 | 0.84 | 200 |
| Example 14 | 5 | 0.82 | 0.88 | 150 |
| Example 15 | 5 | 0.85 | 0.88 | 220 |
| Example 16 | 12 | 0.65 | 0.68 | 420 |
| Example 17 | 10 | 0.68 | 0.70 | 270 |
| Example 18 | 8 | 0.70 | 0.75 | 150 |

TABLE 4-continued

| | Potential change (V) | Relative value of initial torque | Relative value of torque after 2,000 sheets | Number average particle size (nm) |
|---|---|---|---|---|
| Example 19 | 8 | 0.68 | 0.70 | 180 |
| Example 20 | 5 | 0.82 | 0.88 | 110 |
| Example 21 | 5 | 0.85 | 0.88 | 120 |
| Example 22 | 5 | 0.88 | 0.92 | 100 |
| Example 23 | 8 | 0.65 | 0.70 | 290 |
| Example 24 | 10 | 0.62 | 0.65 | 200 |
| Example 25 | 8 | 0.70 | 0.75 | 140 |
| Example 26 | 8 | 0.73 | 0.78 | 150 |
| Example 27 | 5 | 0.75 | 0.78 | 120 |
| Example 28 | 5 | 0.80 | 0.90 | 100 |
| Example 29 | 7 | 0.81 | 0.91 | 150 |
| Example 30 | 5 | 0.82 | 0.92 | 120 |
| Example 31 | 3 | 0.85 | 0.92 | 100 |
| Example 32 | 5 | 0.75 | 0.85 | 180 |
| Example 33 | 5 | 0.78 | 0.88 | 120 |
| Example 34 | 10 | 0.82 | 0.88 | 200 |
| Example 35 | 5 | 0.88 | 0.90 | 220 |
| Example 36 | 20 | 0.70 | 0.75 | 420 |
| Example 37 | 5 | 0.76 | 0.82 | 320 |
| Example 38 | 8 | 0.77 | 0.83 | 340 |
| Example 39 | 5 | 0.88 | 0.90 | 110 |
| Example 40 | 18 | 0.70 | 0.75 | 220 |
| Example 41 | 15 | 0.75 | 0.81 | 300 |
| Example 42 | 15 | 0.74 | 0.80 | 170 |
| Example 43 | 10 | 0.70 | 0.72 | 240 |
| Example 44 | 8 | 0.73 | 0.73 | 180 |
| Example 45 | 25 | 0.65 | 0.67 | 450 |
| Example 46 | 18 | 0.68 | 0.70 | 200 |
| Example 47 | 40 | 0.63 | 0.65 | 500 |
| Example 48 | 25 | 0.65 | 0.68 | 400 |

TABLE 5

| | Potential change (V) | Relative value of initial torque | Relativ value of torque after 2,000 sheets | Number average particle size (nm) |
|---|---|---|---|---|
| Comparative Example 1 | 8 | 1.00 | 1.00 | — |
| Comparative Example 2 | 155 | 0.53 | 0.53 | — |
| Comparative Example 3 | 12 | 0.97 | 0.97 | — |
| Comparative Example 4 | 5 | 0.98 | 0.99 | — |
| Comparative Example 5 | 73 | 0.77 | 0.79 | — |
| Comparative Example 6 | 60 | 0.90 | 0.95 | 180 |
| Comparative Example 7 | 100 | 0.88 | 0.95 | 720 |
| Comparative Example 8 | 15 | 0.96 | 0.98 | — |
| Comparative Example 9 | 120 | 0.82 | 0.85 | 450 |
| Comparative Example 10 | 180 | 0.88 | 0.93 | 250 |
| Comparative Example 11 | 190 | 0.80 | 0.85 | 650 |
| Comparative Example 12 | 8 | 0.95 | 0.98 | — |
| Comparative Example 13 | 15 | 0.68 | 0.98 | — |
| Comparative Example 14 | 250 | 0.70 | 0.76 | — |
| Comparative Example 15 | 150 | 0.88 | 0.90 | — |

The comparison between the Examples and Comparative Example 1 demonstrates that when the siloxane mass ratio relative to a polyester resin A having a siloxane moiety in the charge transport layer are low, a sufficient effect of mitigating contact stress cannot be obtained. This is demonstrated by the results, obtained by the evaluation method of the present invention, that the effect of reducing torque is not exerted when the initial torque is compared to that of 2,000 (sheet) repeated use.

Furthermore, comparison between the Examples and Comparative Example 2 demonstrates that when the siloxane mass ratio to polyester resin A having a siloxane moiety in a charge transport layer is high, the compatibility with a charge transporting material becomes insufficient and aggregation of the charge transporting material occurs in polyester resin A having a siloxane moiety. It is suggested that the potential change occurs by the aggregation.

Furthermore, the comparison between the Examples and Comparative Example 3 demonstrates that when the polyester resin having a siloxane moiety has a small average repeat number of siloxane moieties in the charge transport layer, a sufficient effect of mitigating contact stress cannot be obtained. This is demonstrated by the results, obtained by the evaluation method of the present invention, that the effect of reducing torque is not exerted when the initial torque is compared to that of 2,000 (sheet) repeated use. From the above, this means that the effect of mitigating contact stress varies depending upon the length of siloxane chain.

Furthermore, comparison between the Examples and Comparative Example 4 demonstrates that when the average repeat number of siloxane moieties in the polyester resin having a siloxane moiety in the charge transport layer is low similarly to Comparative Example 3, a sufficient effect of mitigating contact stress cannot be obtained. Furthermore, when the average repeat number of siloxane moieties in the polyester resin having a siloxane moiety in the charge transport layer is low, a matrix-domain structure is not formed different from polyester resin A of the present invention. From the above, it is demonstrated that the effect of mitigating contact stress and formation of a matrix-domain structure depends upon the length of a siloxane chain.

Furthermore, the comparison between the Examples and Comparative Example 5 demonstrates that characteristic difference is produced depending upon the binding position of a phenylene moiety, which binds a siloxane moiety and a dicarboxylic acid moiety. In the binding manner (binding at the para position) of the phenylene moiety shown in Comparative Example 5, the siloxane moiety, which is inferior in compatibility with a charge transporting material, is more linearly arranged to a polymer chain. For this reason, it is presumed that compatibility with a charge transporting material decreases. This is suggested by the fact that an aggregate of a charge transporting material is observed in the polyester resin having a siloxane moiety of Comparative Example 5. On the other hand, in the binding manner (binding at the ortho position shown in Examples, it is considered that since a siloxane moiety is arranged not linearly to the polymer chain, the compatibility is higher and characteristics are stabilized.

Furthermore, comparison between the Examples and Comparative Example 6 demonstrates that formation of a matrix-domain structure is observed in the polyester resin having a siloxane moiety and used in Comparative Example 6, in the same as in polyester resin A of the present invention; however a large potential change is resulted. This is conceivably caused for the same reasons as in Comparative Example 5 since aggregates of a charge transporting material are observed within a domain.

Furthermore, the comparison between the Examples and Comparative Example 7 demonstrates that characteristic difference is produced depending upon the presence or absence of an alkylene group at both ends of a siloxane moiety. In the polyester resin having a siloxane moiety used in Comparative Example 7, formation of a matrix-domain structure is observed as the same as in polyester resin A of the present invention; however a potential change results in being significant. This is because, in the case shown in Comparative Example 7 where the siloxane moiety is directly bound to a phenylene moiety, compatibility of the siloxane moiety with a charge transporting material significantly decreases and aggregates of the charge transporting material are produced within a domain. On the other hand, in polyester resin A of the present invention, an alkylene group is provided at both ends of a siloxane moiety. Therefore, characteristic differences between Examples and Comparative Example 7 are derived from such a structural difference. This suggests that, in the structure of polyester resin A of the present invention, compatibility rarely decreases. It is considered that since the siloxane moiety has an alkylene group at both ends, the structure can be relatively freely modified, improving compatibility.

Furthermore, comparison between the Examples and Comparative Example 8 demonstrates that when a siloxane moiety forms a cyclic structure, an effect of mitigating contact stress is rarely obtained. It is generally known that the effect of mitigating contact stress is exerted by the presence of a siloxane moiety in the surface. In the case where thr siloxane moiety has a straight-chain structure, the glass transition temperature of the siloxane moiety is low and thus the structure of the siloxane moiety is easily changed. Therefore, it is possible to increase the number of siloxane moieties present in the surface. However, if the siloxane moiety has a cyclic structure, a siloxane structure is rarely changed compared to a straight-chain structure. It is thus considered that the above characteristic difference occurs. Furthermore, in the polyester resin of Comparative Example 8 having a siloxane moiety, a matrix-domain structure is not formed different from the polyester resin A of the present invention. From these, it is demonstrated that the effect of mitigating contact stress and formation of a matrix-domain structure are also dependant upon the position of a siloxane moiety.

Furthermore, the comparison between the Examples and Comparative Example 9 demonstrates that when the siloxane moiety has a branched structure, the effect of mitigating contact stress can be obtained; however, a potential change occurs. In the polyester resin having a siloxane moiety and used in Comparative Example 9, formation of a matrix-domain structure is observed similarly to polyester resin A of the present invention; however, aggregates of a charge transporting material are observed within a domain. From this, aggregation of the charge transporting material is considered as a cause.

Furthermore, the comparison between the Examples and Comparative Example 10 demonstrates that potential stability and effect of mitigating contact stress differ depending upon the difference in binding manner of a phenylene group to be bound to dicarboxylic acid. In the polyester resin having a siloxane moiety and used in Comparative Example 10, formation of a matrix-domain structure is observed similarly to polyester resin A of the present invention; however, aggregates of a charge transporting material are observed within a domain. From this, aggregation of the charge transporting material is considered as a cause of potential change. The structure of an alkylene group-methylene group (Comparative Example 10) bound at the ortho position of a phenylene group differs from the structure of an alkylene group-an oxygen atom (Examples). Due to its sterical hindrance, it is presumed that the structure may be relatively fixed in an alkylene group-methylene group. As a result, it is considered that the compatibility with a charge transporting material (which reflects potential stability) differs and effect of mitigating contact stress (caused by free movement of a siloxane chain) differs.

Furthermore, comparison between the Examples and Comparative Example 11 demonstrates that when a carboxylic acid is directly bound to a siloxane moiety, a potential change results in being significant. In the polyester resin having a siloxane moiety and used in Comparative Example 11, formation of a matrix-domain structure is observed similarly to polyester resin A of the present invention, however, aggregates of a charge transporting material are observed within a domain. From this, aggregation of the charge transporting material is considered as a cause. This is considered to be derived from a significant decrease in compatibility of the polyester resin having a siloxane moiety used in Comparative Example 11 with a charge transporting material.

Furthermore, comparison between the Examples and Comparative Example 12 demonstrates that when the polyester resin has a siloxane structure only at an end, since the siloxane mass ratio relative to the polyester resin containing the siloxane moiety in the charge transport layer and the siloxane mass ratio relative to the whole resin in the charge transport layer are low for the reason of the structure, the effect of mitigation contact stress cannot be sufficiently obtained. In addition, differently from polyester resin A of the present invention, a matrix-domain structure is not formed. From these, it is demonstrated that the effect of mitigating contact stress and formation of a matrix-domain structure are also dependant upon the position of a siloxane moiety in a polyester resin.

Furthermore, the comparison between the Examples and Comparative Example 13 demonstrates that when a polycarbonate resin having a siloxane structure is used in combination with a polyester resin containing no siloxane moiety, the effect of mitigating contact stress does not last. This is considered because the polycarbonate resin having a siloxane structure may migrate to the surface.

Furthermore, comparison between the Examples and Comparative Example 14 demonstrates that when the polycarbonate resin has a siloxane structure at an end, formation of a matrix-domain structure is observed and an effect of mitigating contact stress is persistently exerted; however, a significant potential change is resulted. In the polycarbonate resin having a siloxane moiety used in Comparative Example 14, an aggregate of a charge transporting material is observed in a domain. It is therefore considered that the aggregation of a charge transporting material is a cause. On the other hand, in the charge transport layer of the present invention, since a matrix is formed of a charge transporting material having a charge transporting function and at least one of polyester resin C and polycarbonate resin D, it is considered that a potential change can be suppressed.

Furthermore, comparison between the Examples and Comparative Example 15 demonstrates that, in the case of a charge transport layer containing phenyl methyl siloxane, formation of a matrix-domain structure is observed and an effect of mitigating contact stress is persistently exerted; however, a significant potential change is resulted. It is known that a silicone oil material having a siloxane structure, such as phenyl methyl siloxane, has an adverse effect upon potential. It is seemed that this effect is exerted by migration of the silicone oil material to the interface between a charge generation layer and a charge transport layer of a photosensitive laminate. The migration to the interface is suppressed by introduction of a phenyl group but suppression is insufficient. For this reason, potential change conceivably occurs. On the other hand, the polyester resin of the present invention having a siloxane structure has not only a siloxane moiety but also an ester structure. Therefore, the migration to the interface is suppressed. In addition, potential change is conceivably suppressed by formation of a domain.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the priority of Japanese Patent Application No. 2008-187180 filed Jul. 18, 2008, and the content thereof is incorporated by reference as a part of the application.

What is claimed is:

1. An electrophotographic photosensitive member comprising a support, a charge generation layer provided on the support and a charge transport layer containing a charge transporting material and a resin formed on the charge generation layer, the charge transport layer serving as a surface layer of the electrophotographic photosensitive member, wherein:

the charge transport layer contains a charge transporting material, a polyester resin A having a repeating structural unit represented by the following formula (1) and a repeating structural unit represented by the following formula (2), and at least one of polyester resin C having a repeating structural unit represented by the following formula (C) and polycarbonate resin D having a structural unit represented by the following formula (D);

the content of a siloxane moiety in the polyester resin A is not less than 10% by mass and not more than 40% by mass relative to the total mass of the polyester resin A; and the charge transport layer has a matrix-domain structure having a matrix formed of the charge transporting material and at least one of the polyester resin C and the polycarbonate resin D, and a domain formed of the polyester resin A in the matrix, (1)

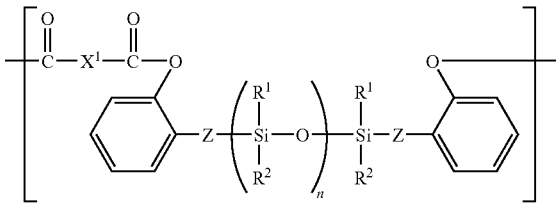

where, in formula (1), $X^1$ represents a divalent organic group; $R^1$ and $R^2$ each independently represent a substituted or unsubstituted alkyl group or a substituted or unsubstituted aryl group; Z represents a substituted or unsubstituted alkylene group having 1 or more and 4 or less carbon atoms; and n represents an average number of repetitions of a structure within the brackets, ranging from 20 or more and 150 or less, wherein the siloxane moiety is the structural unit represented by the following formula

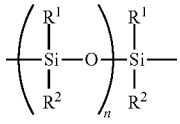

in the above formula (1)

(2)

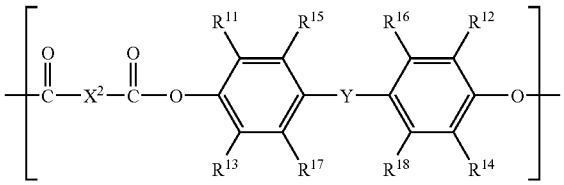

where, in formula (2), $R^{11}$ to $R^{18}$ each independently represent a hydrogen atom, a substituted or unsubstituted alkyl group, a substituted or unsubstituted aryl group or a substituted or unsubstituted alkoxy group; $X^2$ represents a divalent organic group; and Y represents a single bond, a substituted or unsubstituted alkylene group, a substituted or unsubstituted arylene group, an oxygen atom or a sulfur atom, (C)

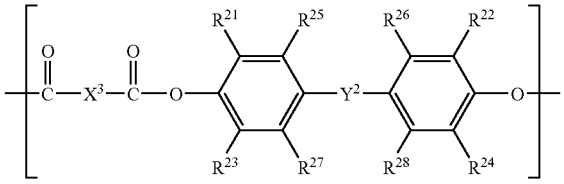

where, in formula (C), $R^{21}$ to $R^{28}$ each independently represent a hydrogen atom, a substituted or unsubstituted alkyl group, a substituted or unsubstituted aryl group or a substituted or unsubstituted alkoxy group; $X^3$ represents a divalent organic group; and $Y^2$ represents a single bond, a substituted or unsubstituted alkylene group, a substituted or unsubstituted arylene group, an oxygen atom or a sulfur atom, (D)

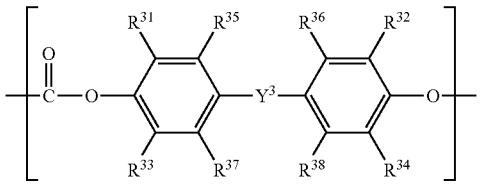

where, in formula (D), $R^{31}$ to $R^{38}$ each independently represent a hydrogen atom, a substituted or unsubstituted alkyl group, a substituted or unsubstituted aryl group or a substituted or unsubstituted alkoxy group; and $Y^3$ represents a single bond, a substituted or unsubstituted alkylene group, a substituted or unsubstituted arylene group, an oxygen atom or a sulfur atom.

2. The electrophotographic photosensitive member according to claim 1, wherein the content of the siloxane moiety in the charge transport layer is not less than 1% by mass and not more than 20% by mass relative to the total mass of the whole resin in the charge transport layer.

3. The electrophotographic photosensitive member according to claim 1, wherein n in the formula (1) is 25 or more and 80 or less.

4. The electrophotographic photosensitive member according to claim 1, wherein the number average particle size of the domain is 100 nm or more and 500 nm or less.

5. The electrophotographic photosensitive member according to claim 1, wherein the content of the siloxane moiety in the charge transport layer is not less than 2% by mass and not more than 10% by mass relative to the total mass of the whole resin in the charge transport layer.

6. The electrophotographic photosensitive member according to claim 1, wherein $X^1$ in the formula (1) is a structure represented by the following formula (3-12) or (3-13) and $X^2$ in the formula (2) is a structure represented by the following formula (3-12) or (3-13):

(3-12)

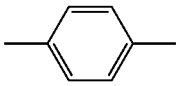

(3-13)

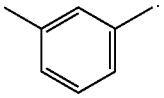

7. The electrophotographic photosensitive member according to claim 1, wherein the charge transport layer contains, as a charge transporting material, a compound represented by the following formula (4):

(4)

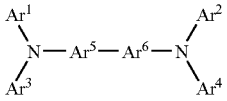

where, in formula (4), $Ar^1$ to $Ar^4$ each independently represent a substituted or unsubstituted aryl group; and $Ar^5$ and $Ar^6$ each independently represent a substituted or unsubstituted arylene group.

8. A process cartridge comprising an electrophotographic photosensitive member according to claim 1 and at least one device selected from the group consisting of a charging device, a developing device, a transfer device and a cleaning device, wherein the electrophotographic photosensitive member and the at least one device are integrally supported and detachably mountable to a main body of an electrophotographic apparatus.

9. An electrophotographic apparatus comprising an electrophotographic photosensitive member according to claim 1, a charging device, an exposure device, a developing device and a transfer device.

* * * * *